US011439184B2

(12) United States Patent
Bowen et al.

(10) Patent No.: US 11,439,184 B2
(45) Date of Patent: Sep. 13, 2022

(54) PUFF SENSING AND POWER CIRCUITRY FOR VAPORIZER DEVICES

(71) Applicant: JUUL Labs, Inc., San Francisco, CA (US)

(72) Inventors: Adam Bowen, San Francisco, CA (US); Alex Cantwell, San Francisco, CA (US); Nicholas Jay Hatton, San Francisco, CA (US); Kevin Lomeli, San Francisco, CA (US); Matthew Rios, San Francisco, CA (US); Bryan White, San Francisco, CA (US)

(73) Assignee: JUUL Labs, Inc., San Francisco, CA (US)

( * ) Notice: Subject to any disclaimer, the term of this patent is extended or adjusted under 35 U.S.C. 154(b) by 946 days.

(21) Appl. No.: 16/200,465

(22) Filed: Nov. 26, 2018

(65) Prior Publication Data

US 2019/0159519 A1 May 30, 2019

Related U.S. Application Data

(60) Provisional application No. 62/593,801, filed on Dec. 1, 2017, provisional application No. 62/590,518, filed on Nov. 24, 2017.

(51) Int. Cl.

| | |
|---|---|
| ***A24F 40/40*** | (2020.01) |
| ***A24F 40/51*** | (2020.01) |
| ***A24F 40/53*** | (2020.01) |
| ***A24F 7/00*** | (2006.01) |
| ***H05B 1/02*** | (2006.01) |
| ***H05B 3/00*** | (2006.01) |
| ***H05B 3/44*** | (2006.01) |
| *A24F 40/10* | (2020.01) |
| *A24F 40/20* | (2020.01) |

(52) U.S. Cl.

CPC ..... *A24F 40/40* (2020.01); *A24F 7/00* (2013.01); *A24F 40/51* (2020.01); *A24F 40/53* (2020.01); *H05B 1/0297* (2013.01); *H05B 3/0019* (2013.01); *H05B 3/44* (2013.01); *A24F 40/10* (2020.01); *A24F 40/20* (2020.01)

(58) Field of Classification Search

CPC ..... A24F 47/00
USPC ..... 131/328–329
See application file for complete search history.

(56) References Cited

U.S. PATENT DOCUMENTS

| | | | |
|---|---|---|---|
| 5,261,424 | A | 11/1993 | Sprinkel, Jr. |
| 6,196,218 | B1 | 3/2001 | Voges |
| 6,516,796 | B1 | 2/2003 | Cox et al. |
| 8,499,766 | B1 | 8/2013 | Newton |
| 8,833,364 | B2 | 9/2014 | Buchberger |
| 9,462,832 | B2 | 10/2016 | Lord |

(Continued)

FOREIGN PATENT DOCUMENTS

| | | |
|---|---|---|
| CN | 203643774 U | 6/2014 |
| CN | 108606366 A | 10/2018 |

(Continued)

*Primary Examiner* — Phuong K Dinh
(74) *Attorney, Agent, or Firm* — Mintz Levin Cohn Ferris Glovsky and Popeo, P.C.

(57) ABSTRACT

Vaporizer device features capable of improving on current approaches to mitigating against device damage or inoperability occurring from liquid exposure (e.g. exposure to liquid vaporizable material possibly affecting a pressure sensor, internal electronic circuitry, and/or electrical contact pins) are described.

18 Claims, 12 Drawing Sheets

(56) References Cited

U.S. PATENT DOCUMENTS

| | | | |
|---|---|---|---|
| 9,839,238 | B2 | 12/2017 | Worm et al. |
| 10,130,123 | B2 | 11/2018 | Hatton et al. |
| 10,188,148 | B2 | 1/2019 | Althorpe et al. |
| 10,375,990 | B2 | 8/2019 | Lord |
| 10,645,971 | B2 | 5/2020 | Zitzke |
| 2011/0036363 | A1 | 2/2011 | Urtsev et al. |
| 2012/0186594 | A1 | 7/2012 | Liu |
| 2013/0233086 | A1 | 9/2013 | Besling et al. |
| 2013/0298905 | A1 | 11/2013 | Levin et al. |
| 2014/0150810 | A1 | 6/2014 | Hon |
| 2014/0276536 | A1 | 9/2014 | Estes |
| 2015/0020831 | A1 | 1/2015 | Weigensberg et al. |
| 2015/0068523 | A1 | 3/2015 | Powers et al. |
| 2015/0159134 | A1 | 6/2015 | Choudhary et al. |
| 2015/0208729 | A1 | 7/2015 | Monsees et al. |
| 2015/0237917 | A1 | 8/2015 | Lord |
| 2015/0313284 | A1 | 11/2015 | Liu |
| 2016/0128389 | A1 | 5/2016 | Lamb et al. |
| 2016/0242466 | A1 | 8/2016 | Lord et al. |
| 2016/0374397 | A1 | 12/2016 | Jordan et al. |
| 2017/0020191 | A1 | 1/2017 | Lamb et al. |
| 2017/0135399 | A1 | 5/2017 | Gavrielov et al. |
| 2017/0146005 | A1 | 5/2017 | Edelen |
| 2017/0157341 | A1 | 6/2017 | Pandya et al. |
| 2017/0245547 | A1 | 8/2017 | Lipowicz |
| 2017/0318861 | A1 | 11/2017 | Thorens |
| 2017/0367407 | A1 | 12/2017 | Althorpe et al. |
| 2018/0020735 | A1* | 1/2018 | Bilat ..... A24F 40/53 131/328 |
| 2018/0146715 | A1 | 5/2018 | Takeuchi et al. |
| 2021/0345681 | A1* | 11/2021 | Cameron ..... A24F 40/10 |

FOREIGN PATENT DOCUMENTS

| | | | |
|---|---|---|---|
| EP | 3000245 | B1 | 2/2018 |
| GB | 2519101 | A | 4/2015 |
| GB | 2522727 | A | 8/2015 |
| RU | 2613785 | C2 | 3/2017 |
| WO | WO-2014205263 | A1 | 12/2014 |
| WO | WO-2015149368 | A1 | 10/2015 |
| WO | WO-2015172224 | A1 | 11/2015 |
| WO | WO-2016000214 | A1 | 1/2016 |
| WO | WO-201 6079151 | A1 | 5/2016 |
| WO | WO-201 6079533 | A1 | 5/2016 |
| WO | WO-2016079155 | A1 | 5/2016 |
| WO | WO-201 6145634 | A1 | 9/2016 |
| WO | WO-2016186859 | A1 | 11/2016 |
| WO | WO-2017001817 | A1 | 1/2017 |
| WO | WO-2017090662 | A1 | 6/2017 |
| WO | WO-2017098410 | A1 | 6/2017 |

* cited by examiner

PUFF SENSING AND POWER CIRCUITRY FOR VAPORIZER DEVICES

CROSS-REFERENCE TO RELATED APPLICATIONS

The current application claims priority to U.S. Provisional Patent Application Nos. 62/590,518 filed Nov. 24, 2017 and 62/593,801 filed Dec. 1, 2017, both entitled "Puff Sensing and Power Circuitry for Vaporizer Devices," the disclosures of which are incorporated herein by reference in their entirety.

The current application is related to the following co-owned patents and/or patent applications, the disclosures of which are incorporated herein by reference. Various nicotine formulations having features that may be used with implementations of the current subject matter are described in one or more of publications US2014/0345631A1 and WO2015/084544A1. Vaporizer devices with features that may relate to implementations of the current subject matter are described in one or more of publications/patents US2015/0150308A1, US2016/0338412A1, US2016/0345631A1, U.S. Pat. No. 9,408,416, US2013/0312742A1, US2017/0079331A1, US2016/0262459A1, US2014/0366898A1, US2015/0208729A1, US2016/0374399A1, US2016/0366947A1, US2017/0035115A1, U.S. Pat. No. 9,549,573, US2017/0095005A1, and US2016/0157524A1, and application Ser. No. 15/605,890.

TECHNICAL FIELD

The subject matter described herein relates to vaporizer devices, such as for example portable personal vaporizer devices for generating an inhalable aerosol from one or more vaporizable materials.

BACKGROUND

Vaporizer devices, which can also be referred to as electronic vaporizer devices or e-vaporizer devices, can be used for delivery of an aerosol (also sometimes referred to as "vapor") containing one or more active ingredients by inhalation of the aerosol by a user of the vaporizing device. Electronic cigarettes, which may also be referred to as e-cigarettes, are a class of vaporizer devices that are typically battery powered and that may be used to simulate the experience of cigarette smoking, but without burning of tobacco or other substances. In use of a vaporizer device, the user inhales an aerosol, commonly called vapor, which may be generated by a heating element that vaporizes (which generally refers to causing a liquid or solid to at least partially transition to the gas phase) a vaporizable material, which may be liquid, a solution, a solid, a wax, or any other form as may be compatible with use of a specific vaporizer device.

To receive the inhalable aerosol generated by a vaporizer device, a user may, in certain examples, activate the vaporizer device by taking a puff, by pressing a button, or by some other approach. A puff, as the term is generally used (and also used herein) refers to inhalation by the user in a manner that causes a volume of air to be drawn into the vaporizer device such that the inhalable aerosol is generated by combination of vaporized vaporizable material with the air. A typical approach by which a vaporizer device generates an inhalable aerosol from a vaporizable material involves heating the vaporizable material in a vaporization chamber (also sometimes referred to as a heater chamber) to cause the vaporizable material to be converted to the gas (vapor) phase. A vaporization chamber generally refers to an area or volume in the vaporizer device within which a heat source (e.g. conductive, convective, and/or radiative) causes heating of a vaporizable material to produce a mixture of air, and the vaporizable material in some equilibrium between the gas and condensed (e.g. liquid and/or solid) phases.

Certain components of the gas-phase vaporizable material may condense after being vaporized due to cooling and/or changes in pressure to thereby form an aerosol that includes particles (gas and/or solid) suspended in at least some of the air drawn into the vaporizer device via the puff. If the vaporizable material includes a semi-volatile compound (e.g. a compound such as nicotine, which has a relatively low vapor pressure under inhalation temperatures and pressures), the inhalable aerosol may include that semi-volatile compound in some local equilibrium between the gas and condensed phases.

The term vaporizer device, as used herein consistent with the current subject matter, generally refers to portable, self-contained, devices that are convenient for personal use. Typically, such devices are controlled by one or more switches, buttons, touch sensitive devices, or other user input functionality or the like (which can be referred to generally as controls) on the vaporizer, although a number of devices that may wirelessly communicate with an external controller (e.g., a smartphone, a smart watch, other wearable electronic devices, etc.) have recently become available. Control, in this context, refers generally to an ability to influence one or more of a variety of operating parameters, which may include without limitation any of causing the heater to be turned on and/or off, adjusting a minimum and/or maximum temperature to which the heater is heated during operation, various games or other interactive features that a user might access on a device, and/or other operations.

SUMMARY

In certain aspects of the current subject matter, challenges associated with the presence of liquid vaporizable materials in or near certain susceptible components of an electronic vaporizer device may be addressed by inclusion of one or more of the features described herein or comparable/equivalent approaches as would be understood by one of ordinary skill in the art.

In one aspect, a vaporizer device may include an absolute pressure sensor positioned to detect a first pressure of air along an airflow path connecting air outside of a vaporizer device body with a vaporization chamber of the vaporizer device and a mouthpiece of the vaporizer device, and an additional absolute pressure sensor positioned to detect a second pressure of air representative of ambient air pressure to which the vaporizer device is exposed. A controller may be configured to perform operations that include receiving a first signal from the absolute pressure sensor representative of the first pressure and a second signal from the additional absolute pressure sensor representative of the second pressure, determining that a puff is occurring based on at least the first signal and the second signal (where the puff includes air flowing along the airflow path in reaction to a user drawing on the mouthpiece) and causing electrical current to be delivered to a resistive heating element of the vaporizer device in response to the determining. The delivered electrical current causes heating of a vaporizable material for forming of an inhalable aerosol in the air flowing along the airflow path.

In another interrelated aspect, a method may include receiving a first signal from an absolute pressure sensor of a vaporizer device, where the first signal is representative of a first pressure, and receiving a second signal from an additional absolute pressure sensor of the vaporizer device, wherein the second signal is representative of the second pressure. The absolute pressure sensor is disposed or positioned to experience the first pressure of air, which occurs along an airflow path connecting air outside of a vaporizer device body with a vaporization chamber of the vaporizer device and a mouthpiece of the vaporizer device. The additional absolute pressure sensor is disposed or positioned to detect the second pressure of air, which is representative of ambient air pressure to which the vaporizer device is exposed. The method may further include determining that a puff is occurring based on at least the first signal and the second signal (where the puff includes air flowing along the airflow path in reaction to a user drawing on the mouthpiece), and causing electrical current to be delivered to a resistive heating element of the vaporizer device in response to the determining.

In optional variations, one or more of the following features may be included in any feasible combination. The operations can further comprise receiving a third signal from an additional sensor and adapting the determining that the puff is occurring based on the third signal. The additional sensor can comprise an accelerometer or another motion sensing device. The airflow path may include a particular orifice size, which can be known and well-characterized, and the absolute pressure sensor may provide a measurement of the pressure drop resulting from a user taking a puff.

In some aspects, the operations performed by the controller further comprise calculating an air velocity and volumetric flow rate, determining an amount of the vaporizable material converted to the vapor phase per unit time, and controlling an amount of the inhalable aerosol generated for a given volume of air based on the calculating and the determining. The operations can further include controlling a temperature of the heater, and/or providing a consistent aerosol concentration across different puff strengths. In yet some other aspects, the operations performed by the controller further comprise applying a correction for ambient pressure to correct for effects of atmospheric pressure on an amount of airflow. The operations can further include prompting the user to take a sample puff or a series of sample puffs, and/or characterizing and storing information regarding a relative strength of a puffing power of the user. In still yet other aspects, the operations can further include varying a size of a pressure drop required to indicate a puff based on the relative strength of the puffing power of the user to better detect actual puffs and reject false positives in detection of user puffing activity.

In another aspect, a vaporizer device having a vaporizer device body shell and an internal skeleton may include a gasket configured to prevent passage of liquids between a volume within a cartridge-receiving receptacle of a vaporizer device body and a volume within the vaporizer device body shell containing internal electronic circuitry (optionally including one or more electronic components, circuit boards, etc.) and/or a power supply. The gasket may include a connective feature via which a pressure sensing device that is connected to part of the internal electronic circuitry is exposed to air pressure in the cartridge-receiving receptacle. Improved sealing of the gasket with the vaporizer device body can be achieved by positioning of a supportive rib on the gasket between a vaporizer device shell and an internal skeleton of the vaporizer device body.

In another aspect, a vaporizer device may include an electrical contact pin for electrical coupling with a contact of a cartridge configured to be insertably received within a cartridge-receiving receptacle of a vaporizer device body. The electrical contact pin may include a liquid-resistant feature.

Systems and methods consistent with this approach are described as well as articles that comprise a tangibly embodied machine-readable medium operable to cause one or more machines (e.g., computers, microcontrollers, or the like, which may include general and/or special purpose processors or circuitry, etc.) to result in operations described herein. Similarly, computer systems are also described that may include a processor and a memory coupled to the processor. The memory may include one or more programs that cause the processor to perform one or more of the operations described herein.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1A:
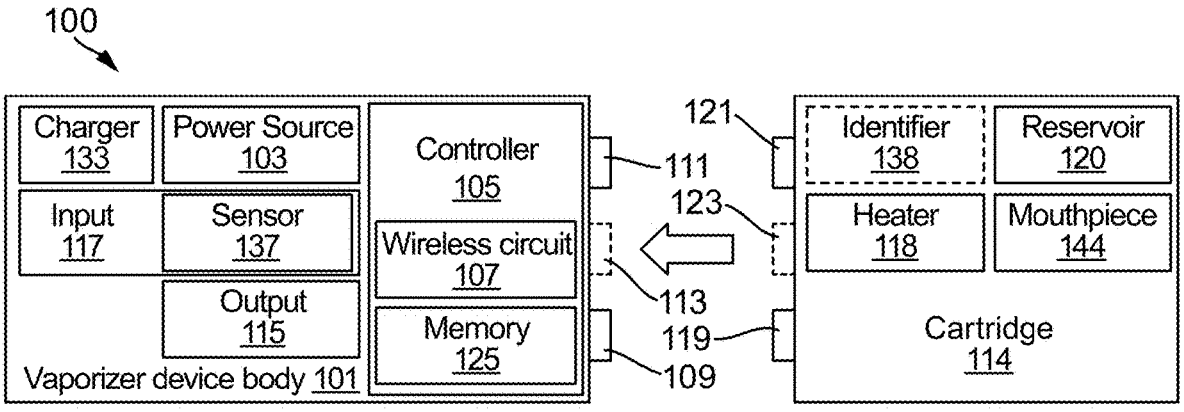
FIG. 1A shows a schematic diagram illustrating features of a vaporizer device having a cartridge and a vaporizer device body consistent with implementations of the current subject matter.
Figure 1B:
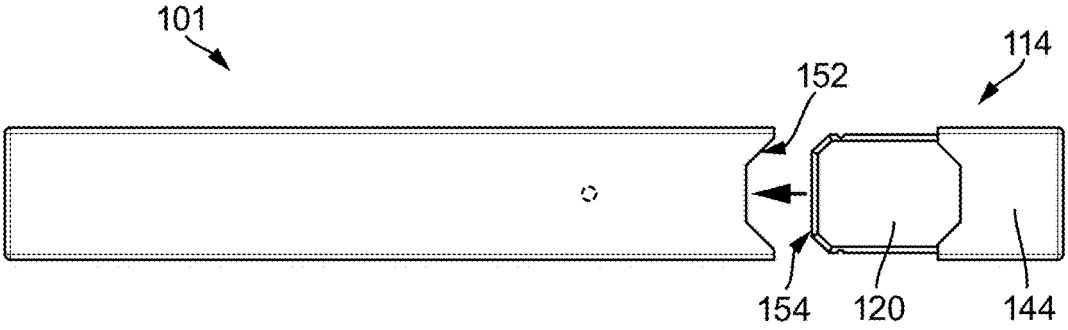
FIG. 1B shows a diagram providing a top view of a vaporizer device with a cartridge separated from a cartridge receptacle on a vaporizer device body consistent with implementations of the current subject matter.
Figure 1C:
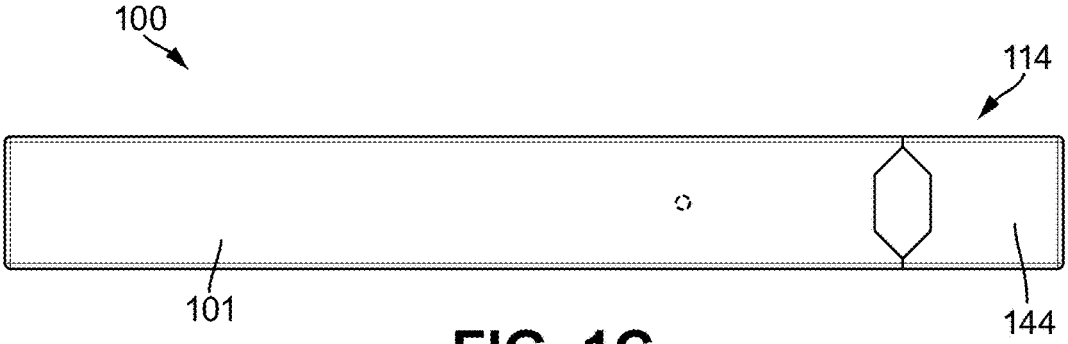
FIG. 1C shows a diagram providing a top view of a vaporizer device with a cartridge inserted into a cartridge receptacle on a vaporizer device body consistent with implementations of the current subject matter.

Examples of vaporizer devices consistent with implementations of the current subject matter include electronic vaporizers, electronic cigarettes, e-cigarettes, and the like. As noted above, such vaporizers are typically hand-held devices that heat (by convection, conduction, radiation, or some combination thereof) a vaporizable material to provide an inhalable dose of the material. The vaporizable material used with a vaporizer may, in some examples, be provided within a cartridge (which may refer to a part of the vaporizer that contains the vaporizable material in a reservoir or other container and that can be refillable when empty or disposable in favor of a new cartridge containing additional vaporizable material of a same or different type). Optionally, a vaporizer device may be any of a cartridge-based vaporizer device, a cartridge-less vaporizer device, or a multi-use vaporizer device capable of use with or without a cartridge. For example, a multi-use vaporizer device may include a heating chamber (e.g. an oven) configured to receive a vaporizable material directly in the heating chamber and also to receive a cartridge having a reservoir or the like for holding the vaporizable material. In various implementations, a vaporizer may be configured for use with liquid vaporizable material (e.g., a carrier solution in which an active and/or inactive ingredient(s) are suspended or held in solution or a liquid form of the vaporizable material itself) or a solid vaporizable material. A solid vaporizable material may include a plant-based or non-plant-based material that emits some part of the solid vaporizable material as the vaporizable material (e.g. such that some part of the material remains as waste after the vaporizable material is emitted for inhalation by a user) or optionally can be a solid form of the vaporizable material itself such that all of the solid material can eventually be vaporized for inhalation. A liquid vaporizable material can likewise be capable of being completely vaporized or can include some part of the liquid material that remains after all of the material suitable for inhalation has been consumed.

Implementations of the current subject matter may provide advantages relative to currently available approaches for activating a vaporizer device in response to a user taking a puff. Alternatively or in addition, implementations of the current subject matter may improve robustness of such devices with regards to long term operability, reduced maintenance, and the like. Other advantages, both explicitly described herein and/or implied or otherwise inherent in light of the descriptions provided may also be generally related to addressing difficulties that may arise in vaporizer devices, particularly those vaporizer devices that are based on a system that includes a cartridge containing (or configured to contain) a vaporizable material and a vaporizer device body into and/or onto which the cartridge is removably coupled. In some examples, a removably coupled cartridge may have a feature (that can optionally include some part or all of a cartridge body) of the cartridge that is insertably received into a cartridge receptacle on a vaporizer device body. Other implementations of a removably coupled cartridge and vaporizer device body may include a part of the vaporizer device body being insertably received into a receptacle on the cartridge. Still other forms of a removably coupled cartridge and vaporizer device body may include a threaded connection in which a threaded male part of the vaporizer device body mates with a corresponding threaded female part of the cartridge and/or in which a threaded male part of the cartridge mates with a corresponding threaded female part of the vaporizer device body.

As noted above, certain vaporizer devices include a cartridge receptacle on a vaporizer body that insertably receives at least part of a cartridge containing a liquid vaporizable material. Other vaporizer device configurations may include one or more of the more general concepts described herein, which, in some implementations, relate to one or more of improved gaskets and/or other sealing features (e.g. for parts of a vaporizer device body), better corrosion resistance for electrical contacts, improved approaches to puff sensing, and the like. Such improvements are more broadly applicable to vaporizer devices in general, including in some examples those that differ in one or more aspects from the vaporizer devices described below as part of the discussions and illustrations of various inventive aspects of the current subject matter. One of ordinary skill in the art will readily understand how to apply these concepts to achieve various benefits, which may include, but are not limited to those enumerated herein.

Possible failure modes of a vaporizer device can include a complete failure to turn on or otherwise operate, intermittent or improperly operating puff sensing, premature discharge or partial or complete failure to charge a power source contained within a vaporizer device, including a vaporizer device body), or the like. Some of these failure modes may be caused or otherwise accelerated by exposure of one or more components of the vaporizer device to liquid vaporizable material. For example, certain parts of the vaporizer device, such as circuit boards, the power source, internal and/or external electrical contacts or circuitry that are part of a charging and/or power supply circuit, etc., may be sensitive to moisture damage and/or corrosion resulting from exposure to liquid vaporizable material and/or other liquids such as condensed water or the like. To prevent or at least reduce exposure of internal components to such damage, the vaporizer device may include one or more gaskets or other sealing features designed to act as a barrier to ingress of liquid into a part of the vaporizer device containing moisture sensitive components. Such a sealing feature may be subject to degradation in its barrier function due to various factors, such as for example user abuse of the vaporizer device (e.g. excessive bending or flexing of the vaporizer device body due to sitting on it or with it in a pants pocket or the like, dropping of the device onto a hard surface, etc.), temperature changes that cause shifting (e.g. due to thermal expansion and/or contraction effects) of a gasket or other sealing feature, interactions of materials used in construction of a gasket or other sealing feature with one or more chemical components of a vaporizable material and/or other environmental factors, or the like.

One or more of the failure modes, for example intermittent or improperly operating puff sensing, failure to provide vapor, complete inoperability of the vaporizer device, etc., may also or alternatively be caused by damage to electrical contacts completing a circuit between a vaporizer device body and a cartridge. For example, vaporizer devices whose functionality involves attachment of a cartridge containing a liquid vaporizable material and a resistive heating element to a separate vaporizer device body containing electronic circuitry and a power source (e.g. a battery, an ultracapacitor, a fuel cell, or the like) may be susceptible to damage resulting from even relatively small amounts of the liquid vaporizable material coming into prolonged contact with electrical contacts on the cartridge and/or the vaporizer device body, particularly when these contacts are not positioned or arranged to allow for easy cleaning. While damage to the contacts on a cartridge may be of relatively minor concern given that the cartridge may be disposable and replaceable within a fairly short time (e.g. after its vaporizable material reservoir is empty or otherwise depleted such that a new cartridge may replace it), damage to electrical contacts in or on the vaporizer device body, which may generally be designed for prolonged use including with a large number of disposable cartridges, can be a significant issue for long term durability. In addition to potential problems relating to damage to the electrical contacts on a vaporizer device, exposure of other parts of the vaporizer device to the liquid vaporizable material can also be problematic as discussed further below.

Electrical contacts for completing a circuit between a vaporizer device body and a cartridge may be present within the cartridge receptacle such that these receptacle electrical contacts are configured and disposed for making contact with corresponding cartridge electrical contacts on a part of the cartridge that is insertably received into the cartridge receptacle when the cartridge and vaporizer body are coupled to allow use of the vaporizer device. Leakage of the liquid vaporizable material from a reservoir that is in or otherwise part of the cartridge may result in that liquid vaporizable material being present on the exterior surfaces of the cartridge when the cartridge is insertably received in the cartridge receptacle on the vaporizer body. The liquid vaporizable material may also or alternatively directly leak from the reservoir while the cartridge is insertably received or otherwise connected or coupled to the vaporizer device body, thereby readily bringing the leaked liquid vaporizable material into close proximity to any components of the vaporizer device body that are exposed within or near the cartridge receptacle. While the discussions herein are presented within the context of an example vaporizer device in which at least part of a cartridge that includes a reservoir for holding liquid vaporizable material is insertably received within a cartridge, it will be understood that such features are not intended to be limiting except to the extent that they are inherently necessary in the subject matter claimed below.

A useful feature of some currently available electronic vaporizer devices is the ability to detect when a user is taking a puff, which is defined herein as inhaling to cause air to be drawn through a vaporization chamber of the vaporizer device. Puff detection functionality can enable user to operate such a device merely by taking a puff rather than having to press a button or perform some other action to cause the device to become capable of generating the inhalable aerosol. Various failure modes of a vaporizer device having puff detection features may include those resulting from a failure or intermittent non-functionality of a pressure sensor that is part of a puff detection system of the vaporizer device. Generally, a pressure sensor is positioned to be exposed to an airflow path delivering air to the vaporization chamber of the vaporizer device. When a user puffs on a mouthpiece to cause air to be drawn along the airflow path, this induces a pressure drop that draws air into the vaporizer device. The pressure drop is detected by the pressure sensor, which provides to a controller (e.g. a microcontroller, a circuit board, other control circuitry etc.) of the vaporizer device a signal indicative of a pressure change. The controller can interpret the signal to determine whether the indicated pressure change was caused by a puff, and if it so determines, the controller can cause activation of a heating element (e.g. a resistive heating element) in response to the signal. The activation of the heating element can include causing delivery of electrical power from a power source to the heating element. The controller can deactivate the heating element upon determining based on the signal from the pressure sensor indicating that the pressure drop has stopped. In some example, the puff detection system can indicate that a puff is continuing (e.g. it has started but not yet ended).

Some currently available vaporizer devices make use of an analog pressure sensor to generate the signal representative of a pressure change (e.g. a pressure drop or a cessation of a pressure drop. In some examples, the pressure sensor may include a capacitive membrane, such as for example a capacitive membrane similar to those used in microphones. However, a capacitive membrane or similar analog pressure sensor may be susceptible to malfunctions when contaminated with liquids such as a liquid vaporizable material, water, etc. For example, an air channel that connects the pressure sensor to the airflow path may become at least partially blocked by a column of liquid. Alternatively, liquid in contact with the capacitive membrane of an analog pressure sensor may dramatically change the capacitive properties of the membrane, thereby causing it to fail to perform as designed and preventing proper detection of a puff.

Use of a pressure sensor for identifying when a user is taking a puff on a vaporizer device generally requires that there be air contact between the pressure sensor and the airstream generated during the puff In some vaporizer devices, the pressure sensor may be positioned a relatively long distance from the reservoir vaporizable material. However, this arrangement is usually achieved by causing the airflow path to pass through some significant portion of a body of the vaporizer device such that contact occurs between the air being drawn by the user with internal electronics and/or circuitry of the vaporizer body. As such, it may be desirable to have the airflow path avoid most of the internals of a vaporizer device body. Doing so, however, may require positioning of the pressure sensor nearer to where the vaporization chamber is, thereby increasing the chance of a leak of vaporizable material bringing the vaporizable material into close proximity with the pressure sensor, which could result in the pressure sensor being disabled due to contact of the liquid vaporizable material with the capacitive membrane.

As noted above, the current subject matter relates to various features that may be beneficial with regard to reducing or even eliminating these failure modes for a vaporizer device. The following description relates to example vaporizer devices within which one or more features of the current subject matter can be implemented. These example vaporizer devices are described to provide context to descriptions of features provided by the current subject matter.

FIGS. 1A-2C illustrate example vaporizer devices 100, 200 and features that may be included therein consistent with implementations of the current subject matter. FIG. 1A shows a schematic view of a vaporizer device 100 that includes a cartridge 114, and FIGS. 1B-1E show views of an exemplary vaporizer device 100 with a vaporizer device body 101 and a cartridge 114. FIGS. 1B and 1C show top views before and after connecting a cartridge 114 to a vaporizer device body 101. FIG. 1D shows an isometric perspective view of the vaporizer device 100, which includes a vaporizer device body 101 combined with a cartridge 114, and FIG. 1E shows an isometric perspective view of one variation of a cartridge 114 holding a liquid vaporizable material. In general, when a vaporizer device includes a cartridge (such as the cartridge 114), the cartridge 114 may include one or more reservoirs 120 configured to contain a vaporizable material (or optionally multiple vaporizable materials). Any appropriate vaporizable material may be contained within the reservoir 120 (or multiple reservoirs) of the cartridge 114, including solutions of nicotine or other organic materials as well as compositions that may include one or more neat (e.g. not dissolved in a solvent) chemical compounds, mixtures, formulations, etc.

As noted above, the vaporizer device 100 shown in FIG. 1 includes a vaporizer device body 101. As shown in FIG. 1, a vaporizer device body 101 consistent with implementations of the current subject matter may include a power source 103 (e.g. a device or system that stores electrical energy for on-demand use), which may be a battery, capacitor, a combination thereof, or the like, and which may be rechargeable or non-rechargeable. A controller 105, which may include a processor (e.g. a programmable processor, special purpose circuitry, or the like), can also be included as part of the vaporizer device body 101. The vaporizer device body 101 may include a housing that encloses one or more of the components of the vaporizer body, such as the power source 103, the controller 105, and/or any of the other components described herein as being part of such a device. In various implementations of a vaporizer device that includes a vaporizer device body 101 and a cartridge 114, the cartridge 114 may be attached on, in, or partially in the vaporizer device body 101. For example, the vaporizer device body 101 may include a cartridge receptacle 152 into which the cartridge 114 may be insertably received.

A processor of the controller 105 may include circuitry to control operation of a heater 118, which can optionally include one or more heating elements for vaporizing a vaporizable material contained within the cartridge 114, for example within a reservoir or container that is part of the cartridge 114. In various implementations, the heater 118 may be present in the vaporizer device body 101 or within the cartridge 114 (as shown in FIG. 1A), or both. The controller circuitry may include one or more clocks (oscillators), charging circuitry, I/O controllers, memory, etc. Alternatively or in addition, the controller circuitry may include circuitry for one or more wireless communication modes, including Bluetooth, near-field communication (NFC), Wi-Fi, ultrasound, ZigBee, RFID, etc. The vaporizer device body 101 may also include a memory 125 that may be part of the controller 105 or otherwise in data communication with the controller. The memory 125 may include volatile (e.g. random access memory) and/or non-volatile (e.g. read-only memory, flash memory, solid state storage, a hard drive, other magnetic storage, etc.) memory or data storage.

Further with reference to FIG. 1, a vaporizer device 100 may include a charger 133 (and charging circuitry which may be controlled by the controller 105), optionally including an inductive charger and/or a plug-in charger. For example, a universal serial bus (USB) connection may be used to charge the vaporizer device 100 and/or to allow communication over a wired connection between a computing device and the controller 105. The charger 133 may charge the onboard power source 103. A vaporizer device 100 consistent with implementations of the current subject matter may also include one or more inputs 117, such as buttons, dials, or the like, a sensor 137, which may include one or more sensors such as accelerometers or other motion sensors, pressure sensors (e.g. relative and/or absolute pressure sensors, which may be capacitive, semiconductor-based, etc.), flow sensors, or the like. One more such sensors 137 may be used by the vaporizer device 100 to detect user handling and interaction. For example, detection of a rapid movement (such as a shaking motion) of the vaporizer device 100 may be interpreted by the controller 105 (e.g. through receipt of a signal from one or more of the sensors 137) as a user command to begin communication with a user device that is part of a vaporizer system and that can be used for controlling one or more operations and/or parameters of the vaporizer device 100 as described in more detail below. Additionally or alternatively, detection of a rapid movement (such as a shaking motion) of the vaporizer device 100 may be interpreted by the controller 105 (e.g. through receipt of a signal from one or more of the sensors 137) as a user command to cycle through a plurality of temperature settings to which the vaporizable material held within the cartridge 114 is to be heated by action of the heater 118. In some optional variations, detection of removal of the cartridge 114 by the controller 105 (e.g. through receipt of a signal from one or more of the sensors 137) during a cycling-through of the plurality of temperature settings may act to establish the temperature (e.g., when the cycle is at a desired temperature, a user may remove the cartridge 114 to set the desired temperature). The cartridge 114 may then be re-engaged with the vaporizer device body 101 by the user to allow use of the vaporizer device 100 with the heater controlled by the controller 105 consistent with the selected temperature setting. The plurality of temperature settings may be indicated through one or more indicators on the vaporizer device body 101. A pressure sensor can, as noted above, be used in detection of any of a start, an end, or a continuation of a puff.

A vaporizer device 100 consistent with implementations of the current subject matter may also include one or more outputs 115. Outputs 115 as used herein can refer to any of optical (e.g., LEDs, displays, etc.), tactile (e.g., vibrational, etc.), or sonic (e.g., piezoelectric, etc.) feedback components, or the like, or some combination thereof.

A vaporizer device 100 consistent with implementations of the current subject that includes a cartridge 114 may include one or more electrical contacts (e.g., pins, plates, sockets, mating receptacles or other features for coupling electrically with other contacts, etc.), such as the vaporizer device body electrical contacts 109, 111, 113 shown in FIG. 1A) on or within the vaporizer device body 101 that may engage complementary cartridge contacts 119, 121, 123 (e.g., pins, plates, sockets, mating receptacles or other features for coupling electrically with other contacts, etc.) on the cartridge 114 when the cartridge is engaged with the vaporizer device body 101. The contacts on the vaporizer body 101 are generally referred to herein as "vaporizer body contacts" and those on the cartridge 114 are generally referred herein to as "cartridge contacts." These contacts may be used to provide energy from the power source 103 to the heater 118 in implementations of the current subject matter in which the heater 118 is included in the cartridge 114. For example, when the cartridge contacts and the vaporizer body contacts are respectively engaged by coupling of the cartridge 114 with the vaporizer device body 101, an electrical circuit can be formed allowing control of power flow from the power source 103 in the vaporizer device body 101 to the heater 118 in the cartridge 114. A controller 105 in the vaporizer device body 101 can regulate this power flow to control a temperature at which the heater 118 heats a vaporizable material contained in the cartridge 114.

While three vaporizer device body contacts 109, 111, 113 and three cartridge contacts 119, 121, 123 are shown, certain implementations of the current subject matter may use only two of each type of contacts to complete an electrical circuit that can be used for power delivery from the power source 103 to the heater 118 and optionally also for measuring a temperature of a heating element in the heater (e.g. by briefly and intermittently interrupting a flow of current to the heating element, measuring a resistance of the heating element during these brief interruptions, and using a thermal resistance coefficient to obtain temperature from the measured resistance) and/or transmitting data between an optional identifier 138 and the controller 105. Alternatively or in addition, additional contacts (e.g. optional contacts 113 and 123, which can be more than one additional contact on each of the cartridge and the vaporizer device body) may be included for data passing, temperature measurements, pressure sensor measurements (e.g. if a pressure sensor is included on the cartridge while the controller 105 is in the vaporizer device body 101).

An airflow path (150, in FIG. 1E) can direct air to the heater, where the air is combined with vaporized vaporizable material from a reservoir 120 such that an inhalable aerosol is generated for delivery to a user via a mouthpiece 144, which can also be part of the cartridge 114. The airflow path 150 may, in some examples, pass between an outer surface of the cartridge 114 and an inner surface of a cartridge receptacle on the vaporizer device body 101 as described further below.

Any compatible electrical contact may be used, including pins (e.g., pogo pins), plates, and the like. In addition, as described below, in some implementations of the current subject matter one-way or two-way communication is provided between the vaporizer device body 101 and the cartridge 114 through one or more electrical contacts, which may include the electrical contacts used to provide energy from the power source 103 to the heater 118, which may include a heating element such as a resistive heating element. The cartridge 114 and the vaporizer device body 101 may be removably coupled together, e.g., by engaging a portion of a housing of the cartridge 114 with the vaporizer device body 101 and/or the vaporizer housing in a mechanical connection (e.g., a snap and/or friction fit). Alternatively or additionally, the cartridge 114 and the vaporizer device body 101 may be coupled magnetically or via some other coupling or engaging mechanism. Other connection types are also within the scope of the current subject matter, as are combinations of two or more connection types.

Figure 1D:
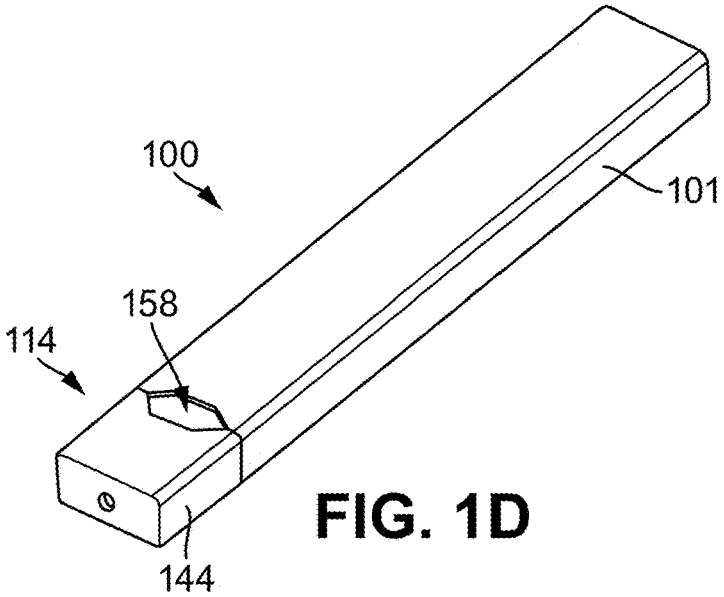
FIG. 1D shows a diagram providing a top isometric perspective view of a vaporizer device with a cartridge inserted into a cartridge receptacle on a vaporizer device body consistent with implementations of the current subject matter.
Figure 1E:
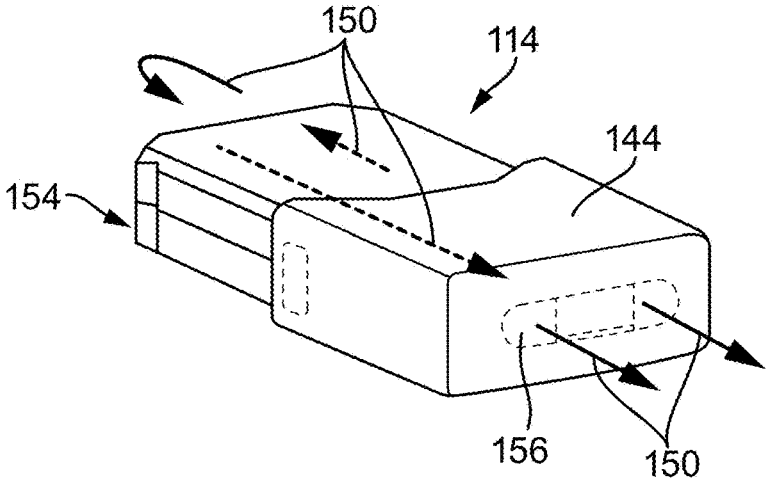
FIG. 1E shows a diagram providing a top isometric perspective view from a mouthpiece end of a cartridge suitable for use with a vaporizer device body consistent with implementations of the current subject matter.
Figure 1F:
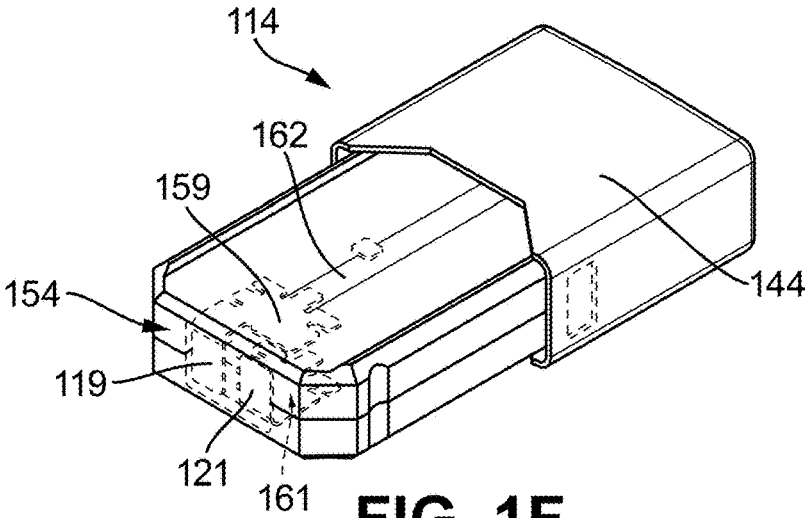
FIG. 1F shows a diagram providing a top isometric perspective view from an opposite end of a cartridge suitable for use with a vaporizer device body consistent with implementations of the current subject matter.

FIGS. 1B to 1F illustrate an example of a vaporizer 100 with a vaporizer device body 101 and cartridge 114. The two are shown unconnected in FIG. 1B and connected in FIG. 1C. FIG. 1D shows an isometric perspective view of the combined vaporizer device body 101 and cartridge 114, and FIG. 1E and FIG. 1F shows an individual cartridge 114 from two different views. FIGS. 1B-1F in combination illustrate an example cartridge-based vaporizer device including many of the features generally shown in FIG. 1A. Other configurations, including some or all of the features described herein, are also within the scope of the current subject matter. FIG. 1D shows a vaporizer device 100 having a cartridge 114 coupled into a cartridge receptacle 152 of the vaporizer device body 101. In some implementations of the current subject matter, the reservoir 120 may be formed in whole or in part from translucent material such that a level of the vaporizable material is visible from a window 158. The cartridge 114 and/or the vaporizer device body 101 may be configured such that the window 158 remains visible when the cartridge 114 is insertably received by the cartridge receptacle 152. For example, in one exemplary configuration, the window 158 may be disposed between a bottom edge of the mouthpiece 144 and a top edge of the vaporizer device body 101 when the cartridge 114 is coupled with the cartridge receptacle 152.

FIG. 1E illustrates an example of an airflow path 150 for air to be drawn by a user puff from outside of the cartridge 114 past the heater 118 (e.g. through a vaporization chamber that includes or contains the heater 118, and on to the mouthpiece 144 for delivery of the inhalable aerosol. The mouthpiece may optionally have multiple openings through which the inhalable aerosol is delivered. For example, a cartridge receptacle 152 may be present at one end of a vaporizer device body 101, such that an insertable end 154 of the cartridge 114 may be insertably received into the cartridge receptacle 152. When the cartridge insertable end 154 is fully inserted into the cartridge receptacle 152, an inner surface of the cartridge receptacle 152 forms one surface of part of the airflow path 150 and an exterior surface of the cartridge insertable end 154 forms another surface of that part of the airflow path.

As shown in FIG. 1E, this configuration causes air to flow down around the cartridge insertable end 154 into the cartridge receptacle 152 and then back in the opposite direction after passing around the inserted end (e.g. an end opposite an end that includes the mouthpiece 144) of the cartridge 114 as it enters into the cartridge body toward the vaporization chamber and heater 118. The airflow path 150 then travels through the interior of the cartridge 114, for example via one or more tubes or internal channels to one or more outlets 156 formed in the mouthpiece 144. For a cartridge having a non-cylindrical shape 144, the mouthpiece 114 may likewise be non-cylindrical, and more than one outlets 156 may be formed in the mouthpiece, optionally arranged in a line along a longer of two transverse axes of the cartridge 114, where a longitudinal axis of the cartridge is oriented along a direction the cartridge 114 is moved to be insertably received or otherwise coupled to the vaporizer device body 101 and the two transverse axes are perpendicular to each other and to the longitudinal axis.

FIG. 1F shows additional features that may be included in a cartridge 114 consistent with the current subject matter. For example, the cartridge 114 can include two cartridge contacts 119, 121 disposed on the insertable end 154, which is configured to be inserted into the cartridge receptacle 152 of a vaporizer device body 101. These cartridge contacts 119, 121 can optionally each be part of a single piece of metal that forms a conductive structure 159, 161 connected to one of two ends of a resistive heating element. The two conductive structures can optionally form opposing sides of a heating chamber and can also act as heat shields and/or heat sinks to reduce transmission of heat to outer walls of the cartridge 114. FIG. 1F also shows a central tube 162 within the cartridge 114 that defines part of the airflow path 150 between the heating chamber formed between the two conductive structures 159, 161 and the mouthpiece 144.

As mentioned above, the cartridge 114 and optionally the vaporizer device body 101 may optionally be non-circular in cross section, with various oblong (e.g. one of two transverse axes which are orthogonal to a longitudinal axis of the vaporizer device 100 being longer than the other) cross-sectional shapes contemplated, including approximately rectangular, approximately rhomboidal, approximately triangular or trapezoidal, approximately oval in shape, etc. It will be well understood by one of ordinary skill in the art that the use of "approximately" in this context contemplates that any vertices of the cross-sectional shape need not be sharp, but can instead have a non-zero radius of curvature, and that any surfaces between such vertices need not be completely planar but can instead have a non-infinite radius of curvature.

Figure 2A:
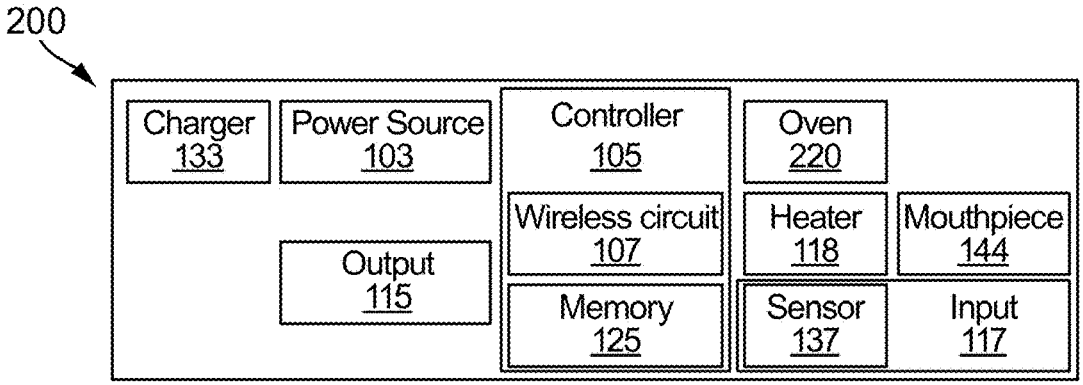
FIG. 2A shows a schematic diagram illustrating features of a non-cartridge-based vaporizer device consistent with implementations of the current subject matter.
Figure 2B:
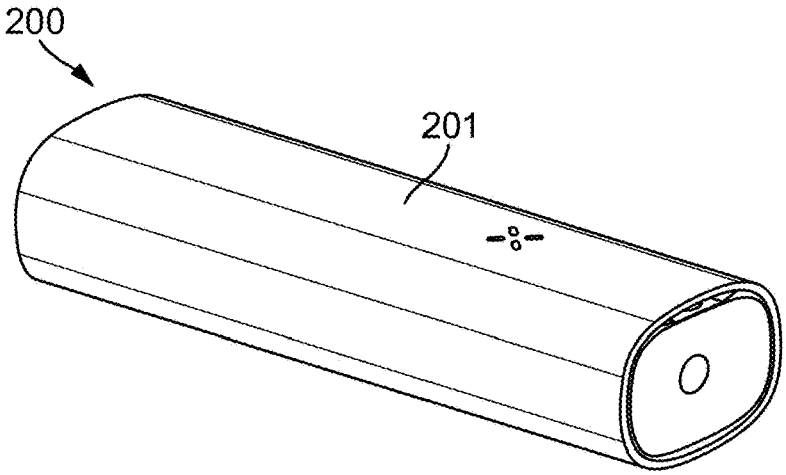
FIG. 2B shows a diagram providing a side isometric perspective view of a non-cartridge-based vaporizer device.
Figure 2C:
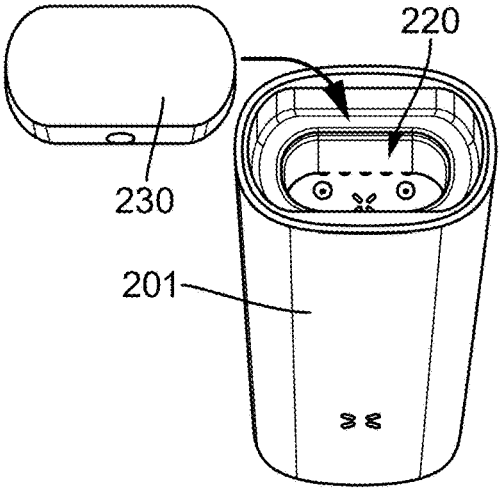
FIG. 2C shows a diagram providing a bottom isometric perspective view of the non-cartridge-based vaporizer device.

FIGS. 2A-2C relate to an example implementation of the current subject matter in which the vaporizer device is not cartridge based. FIG. 2A shows a schematic diagram of a vaporizer device 200 that does not use a cartridge (but may still optionally accept a cartridge), but may instead (or additionally) be configured for use with a loose-leaf material or some other vaporizable material (e.g. a solid, a wax, etc.). The vaporizer device 200 in FIG. 2A may be configured to receive, in an oven 220 (e.g., a vaporization chamber), a vaporizable material such as a loose vaporizable material, a wax, and/or some other liquid or solid vaporizable material. Many elements similar to those present in the vaporizer device 100 using a cartridge 114 shown in FIG. 1A-1E may also be included as part of a vaporizer device 200 that does not require use of cartridges. For example, a vaporizer device 200 may include, in one housing, control circuitry 105 which may include power control circuitry, and/or wireless circuitry 207, and/or memory 125. A power source 103 (e.g., a battery, capacitor, etc.) within the housing may be charged by a charger 133 (and may include charging control circuitry, not shown). The vaporizer device 200 may also include one or more outputs 115 and one or more inputs 117 with sensors 137, which may include one or more of the sensors discussed above in regards to the cartridge-based vaporizer device 100. In addition, the vaporizer device 200 may include one or more heaters 118 that heat a vaporization chamber, which may be an oven 220 or other heating chamber. The heater 118 may be controlled using the resistance of the heater 118 to determine the temperature of the heater, e.g., by using the temperature coefficient of resistivity for the heater. A mouthpiece 144 may also be included in such a vaporizer device 200 for delivery of a generated inhalable aerosol to a user. FIG. 2B shows a side isometric perspective of an exemplary vaporizer device 200 with a vaporizer device body 201. In the bottom isometric perspective view of FIG. 2C, a lid 230 is shown removed from the vaporizer body 201, exposing the oven/vaporization chamber 220.

Figure 3A:
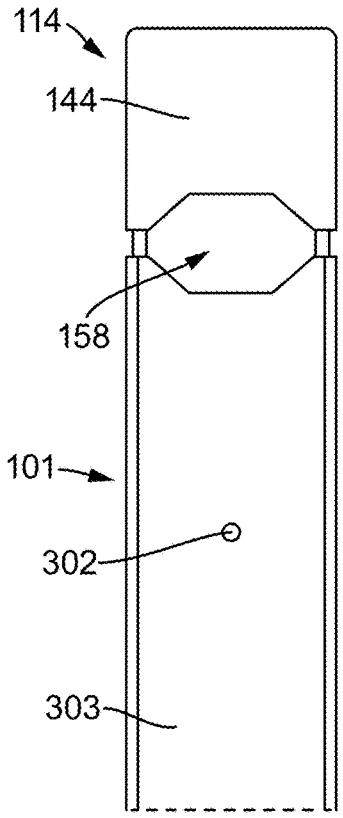
FIG. 3A shows a diagram illustrating a top view of a vaporizer device body.
Figure 3B:
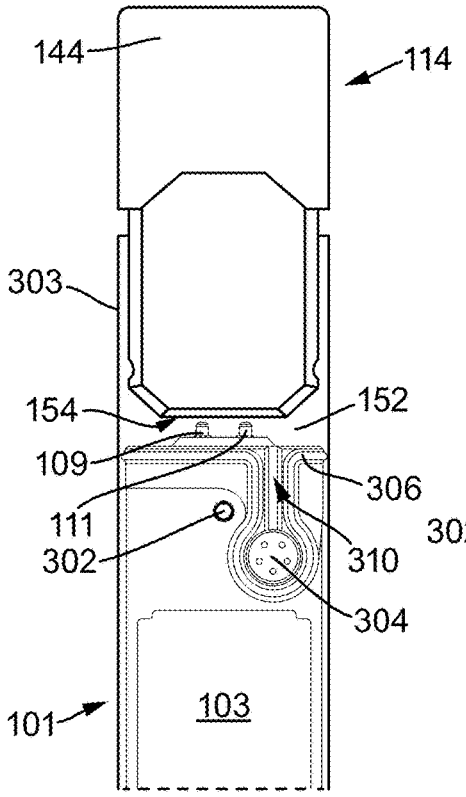
FIG. 3B shows a diagram illustrating a cutaway top view of a vaporizer device body having a gasket.
Figure 3C:
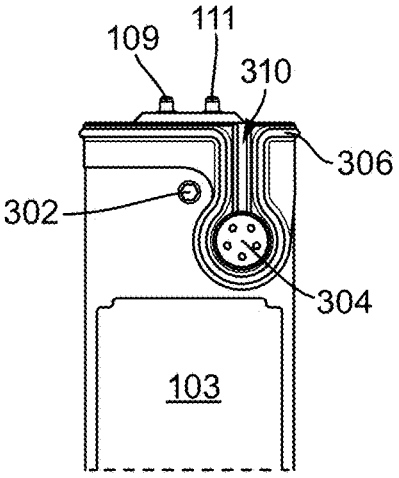
FIG. 3C shows a diagram illustrating another cutaway top view of a vaporizer device body having a gasket.
Figure 4:
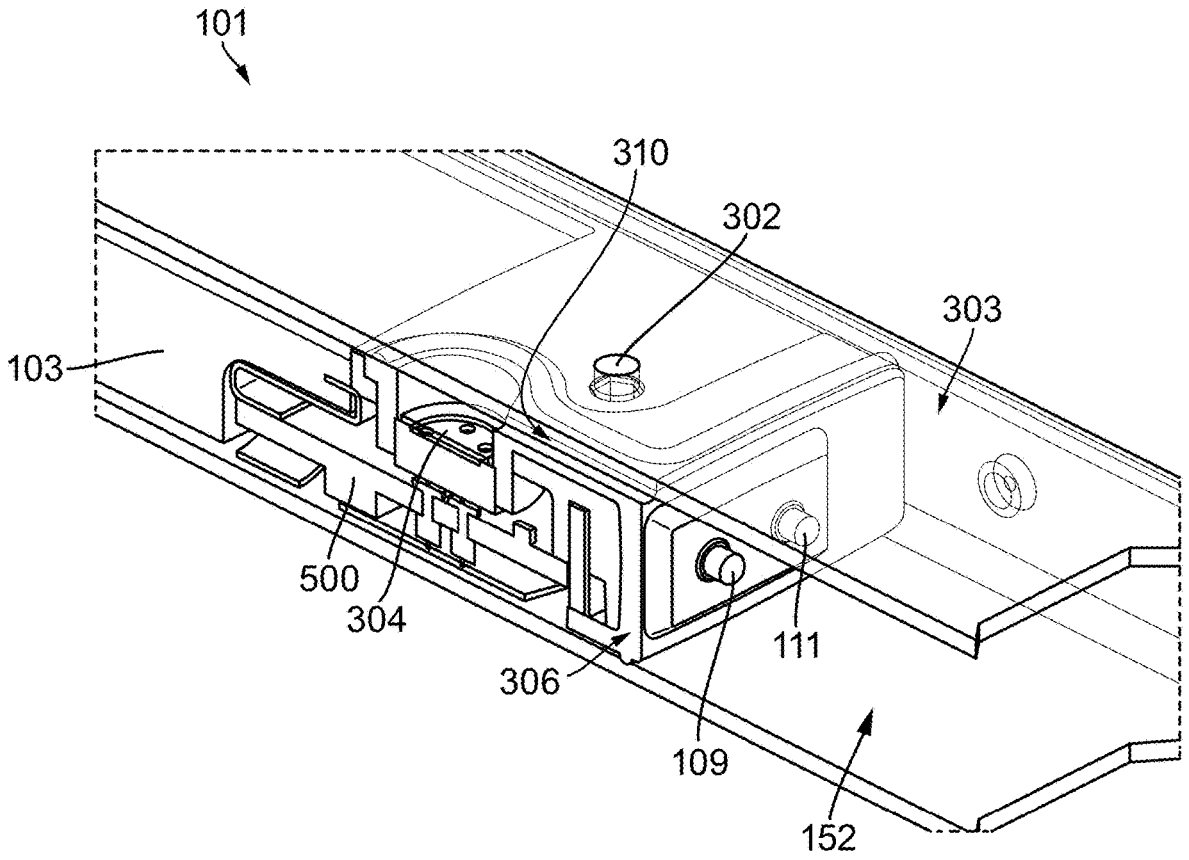
FIG. 4 shows a diagram providing an isometric view of a vaporizer device body.

FIG. 3A, FIG. 3B, FIG. 3C, and FIG. 4 respectively show views of a vaporizer device body 101, from an external top view (FIG. 3A), a top cutaway view (FIG. 3B) showing the outer shell as transparent to reveal internal components, a top view with the outer shell removed (FIG. 3C), and a side/top isometric cutaway view (FIG. 4). The vaporizer device body 101 includes the outer shell 303 which, in this example, includes a port 302 (e.g. an opening, a window, or the like in the outer shell 303) via which a visible indicator (e.g. a light, a light emitting diode, a light pipe, a fiber optic device, etc.) can provide feedback on a device state to a user. The port 302 appears in all of FIG. 3A, FIG. 3B, FIG. 3C, and FIG. 4. The views in FIG. 3A and FIG. 3B show an example of a cartridge 114 insertably received into a cartridge receptacle 152 to configure the vaporizer device 100 for use. The views of FIG. 3B and FIG. 3C also show a power source 103 that is positioned within the vaporizer device body 101 as well as a pressure sensor 304, a gasket 306 or other sealing features providing a barrier between the cartridge receptacle 152 and various internal components of the vaporizer device body 101. The pressure sensor 304 is positioned and the gasket 306 is shaped such that the pressure sensor is exposed to air within the cartridge receptacle 152 via a channel 310 (e.g. a gap, a passageway, or some other connection that allows ready transmission of changes in air pressure along its length) such that the pressure sensor is exposed to air and/or other environmental factors present on the external side of the gasket 306.

Use of a pressure sensor for identifying when a user is taking a puff on a vaporizer device generally requires that there be contact between the pressure sensor and the airstream generated during the puff In some vaporizer devices, the pressure sensor may be positioned a relatively long distance from the reservoir of vaporizable material. However, this arrangement is usually achieved by causing the airflow path to pass through some part of the body of the vaporizer device such that the air being drawn by the user comes into close contact with internal electronics and/or circuitry of the vaporizer body. Such an arrangement can be undesirable for long term device functionality, for example because moisture, dust, etc. from the incoming air may deposit on sensitive internal electronics of the vaporizer device. Positioning the pressure sensor (e.g. the puff detector) closer to the reservoir (e.g. near to where a cartridge 114 containing the reservoir 120 is inserted into or received onto the vaporizer device body 101) can alleviate this issue by avoiding air flow over internal features of the vaporizer device body. However, this placement of the pressure sensor can cause it to be more susceptible to exposure to liquid vaporizable material, etc., which may result in disabling of an analog pressure sensor as discussed above.

Airflow into a cartridge 114 that is insertably received within the cartridge receptacle 152 may, in some implementations of the current subject matter, follow an airflow path 150 that through a gap between a side wall (e.g. an exterior surface of the part of the cartridge 114 that is insertably received in the cartridge receptacle 152) of the cartridge 114 and an inner wall of the cartridge receptacle 152 as illustrated in FIG. 3B. From within the cartridge receptacle 152, the air can flow into the cartridge 114 via one or more air inlets located at or near an end of the cartridge that is opposite the mouthpiece 144. The channel 310 connecting air within the cartridge receptacle 152 with the pressure sensor 304 is shown in FIG. 3B and FIG. 3C. This configuration can be generally described as positioning the pressure sensor 304 to be exposed to pressure changes (and consequently also to environmental factors such as moisture, leakage of vaporizable material, dirt, etc.) that occur or are present in the cartridge receptacle 152.

The cartridge receptacle 152 may, as shown in FIG. 3B and FIG. 3C, also include or contain electrical contacts as well as the channel 310 through which pressure changes in the cartridge receptacle 152 are measured by the analog pressure sensor 304. The electrical contacts shown in FIG. 3B and FIG. 3C include two "pins" 109, 111 that are configured to electrically couple with corresponding contacts 119, 121 on the cartridge. In some implementations of the current subject matter, the cartridge 114 may be rotationally symmetric, and the two electrical contacts 119, 121 may be equivalent such that the cartridge 114 may be insertably received into the cartridge receptacle 152 in either of two orientations.

Figure 5:
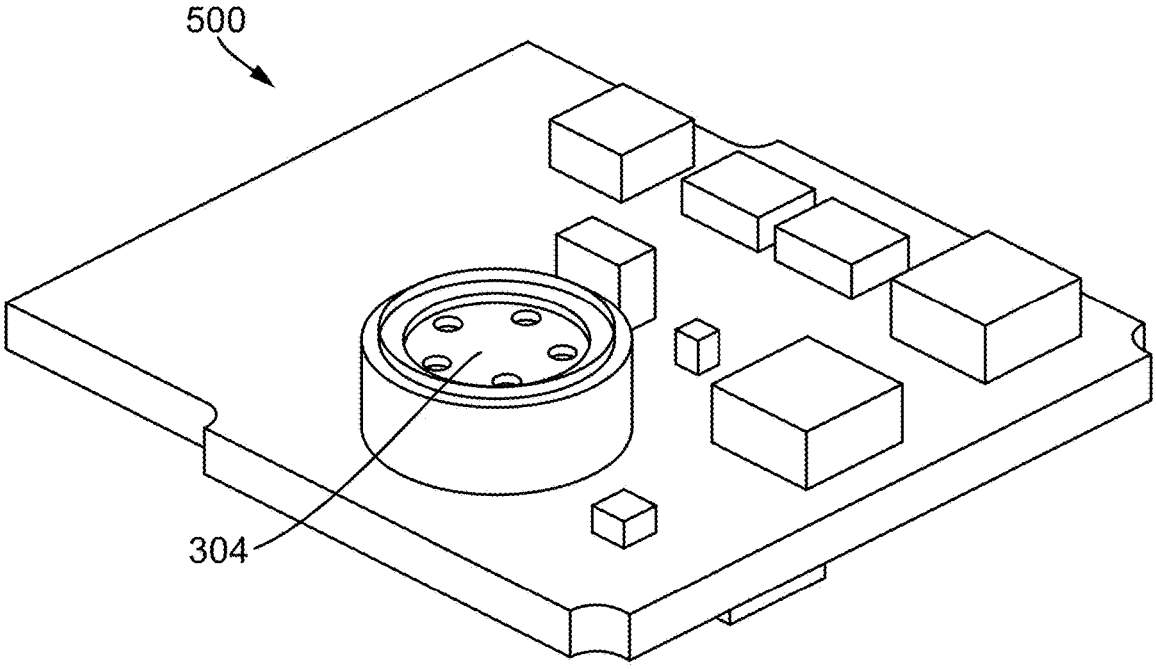
FIG. 5 shows an isometric view of a circuit board for a vaporizer device including an analog pressure sensor.

As noted above, a potential failure mode of a vaporizer device 100 that makes use of an analog pressure sensor (e.g. a capacitive sensor, microphone, etc.) can occur as a result of liquid exposure or other contamination of the channel 310 via which the analog pressure sensor 304 is in communication with airflow into the cartridge. In some implementations of the current subject matter, an absolute pressure sensor, such as for example a microelectromechanical system (MEMS) or other semiconductor-based sensor can be used in place of an analog sensor. A semiconductor-based sensor or the like can be a digital component that returns a signal or value representative of an absolute pressure to which the pressure sensor is currently exposed. Such sensors can be waterproof and substantially less susceptible to the effects of exposure to liquid vaporizable material than an analog pressure sensor. FIG. 5 shows an example of a circuit board 500 having a capacitive sensor 304 (e.g. an analog pressure sensor) mounted on it for inclusion in a vaporizer device 100 such as those discussed herein. The circuit board 500, which is merely an example of how an analog pressure sensor 304 can be configured in a vaporizer device 100, includes the analog pressure sensor 304 mounted such that when the circuit board 500 is installed in the vaporizer device body 101, the analog pressure sensor 304 is aligned with a receiving feature on the gasket 306.

Figure 6:
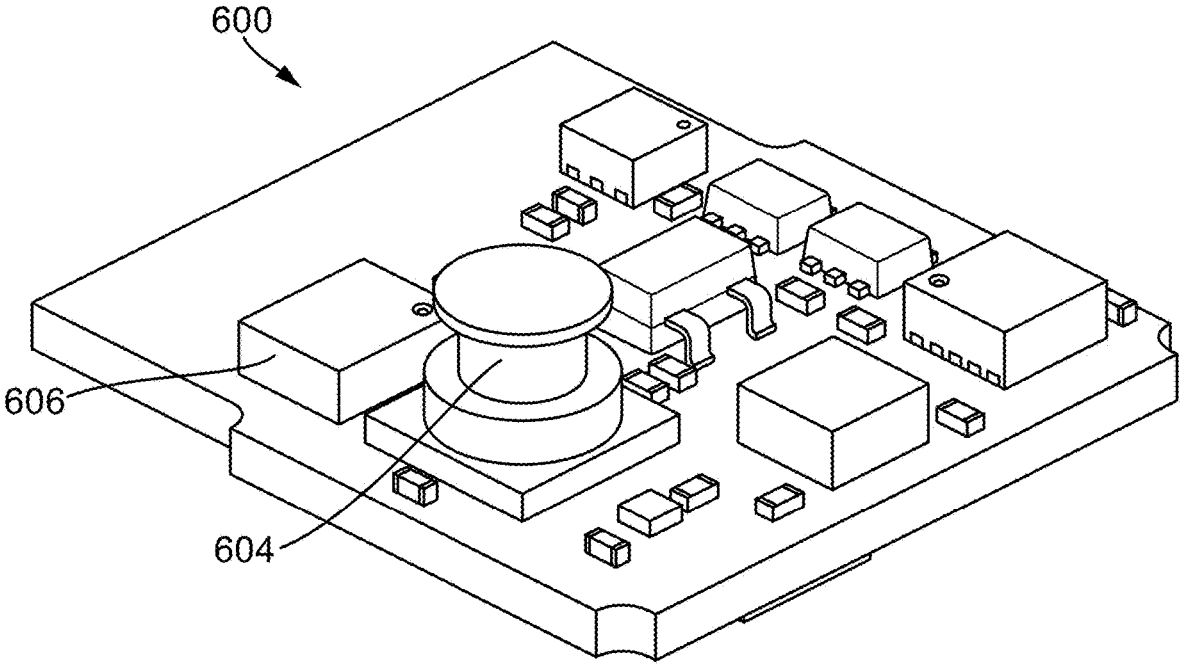
FIG. 6 shows an isometric perspective view of a circuit board for a vaporizer device including an absolute pressure sensor consistent with implementations of the current subject matter.

An improvement on this design provided in various implementations of the current subject matter is shown in FIG. 6, which illustrates features of a different circuit board 600 in which an absolute pressure sensor 604 replaces the analog pressure sensor 304 of FIG. 5. As shown, the circuit board 600 with the absolute pressure sensor 604 can be configured to position the absolute pressure sensor 604 at a similar position as the analog pressure sensor 304 on the circuit board 500. In this manner, the absolute pressure sensor 604 can be configured to fit into the receiving feature on the gasket 306 in a similar manner to the analog pressure sensor 304 on the circuit board 500. An absolute pressure sensor 604 may be as much as five or more times more sensitive than a conventional capacitive sensor. Additionally, a MEMS or other semiconductor-based pressure sensor can also provide significant improvements in repeatability (e.g. precision) of measurements relative to currently employed approaches.

While a semiconductor-based absolute pressure sensor 604 or other similar devices that are not rendered ineffective or inoperable by exposure to liquids can readily address the above-noted issues that result from exposure, use of such a device can present other challenges. For example, an analog pressure sensor 304, in particular one that works via a capacitive measurement of a membrane that moves in reaction to differences in pressure on either side of the membrane provides a relative pressure measurement that can readily differentiate between local pressure changes on a first side of the membrane that is exposed, via a channel 310 or the like, to the airflow into a cartridge 114 and ambient pressure changes that may be caused by altitude changes, the Venturi effect (e.g. as might be caused by opening of a vehicle window while moving at a relatively high speed, a door of a boat or other structure exposed to high winds, or the like), pressure waves (e.g. as might be caused by a vehicle, such as a train or the like, entering a tunnel or other constrained air volume), etc. If a signal produced by the absolute pressure sensor 604 is used alone for determining whether a puff is occurring, the potential for a false positive is greater than with a relative pressure sensor. In light of the other advantages of an absolute, semi-conductor-based pressure sensor 604, the current subject matter can, in some implementations, include additional sensors and firmware and/or software for determining whether a puff is or is not occurring based on input from the absolute pressure sensor 604 as well as from one or more other sensors. The one or more other sensors can include a second pressure sensor, and optionally one or more sensors that measure something other than pressure.

In one example, the vaporizer device body 101 can include an additional absolute pressure sensor 606 that provides a signal to the controller 105. A virtual relative pressure sensor can thereby be created through signal processing from at least two absolute pressure sensors. The additional absolute pressure sensor 606 can be positioned to measure an ambient pressure to which the vaporizer device 100 is currently exposed. In some examples, the additional absolute pressure sensor 606 can be positioned on the circuit board 600 such that the additional absolute pressure sensor 606 is not exposed to pressure in the cartridge receptacle 152 but instead to pressure in the vaporizer device body 101, which can have one or more openings to expose the additional absolute pressure sensor (or otherwise just not be completely sealed relative) to ambient pressure. Alternatively, the additional absolute pressure sensor 606 can be positioned, arranged, etc. to have a direct exposure to ambient air and ambient pressure outside of a shell of the vaporizer device 100, for example by being exposed via a channel, port, opening, or the like in the shell.

Signals from the absolute pressure sensor 604 and the additional absolute pressure sensor 606 may be received at the controller 105 of the vaporizer device 100, which can use these signals to determine or otherwise identify a pressure change of the absolute pressure sensor 604 relative to ambient pressure and thereby implement logic to exclude pressure changes detected by the absolute pressure sensor 604 that are not related to a puff or the airflow-induced pressure change. Alternatively or in addition, the logic can be implemented directly in hardware, for example via a series of transistors forming logic gates, or in some combination of software hardware, and/or firmware. In some examples, this logic can include comparing absolute pressure measured by both of the absolute pressure sensor 604 and the additional absolute pressure sensor 606 and determining that a puff is occurring when the signal from absolute pressure sensor 604 indicates a pressure drop of some amount (e.g. absolute, fractional, etc.) that is larger than a pressure drop indicated by the additional absolute pressure sensor 606. In this manner, the signals received at the controller from the additional absolute pressure sensor 606 may act as a gating signal to reject signals from the absolute pressure sensor 604 that the controller would otherwise interpret as indicative of a puff but that may instead be due to ambient pressure changes.

A vaporizer device consistent with implementations of the current subject matter may also be subject to other factors capable of causing incorrect puff detection. For example, even though an absolute pressure sensor 604 as discussed above may be waterproof and/or otherwise impervious or at least resistant to becoming inoperable or otherwise malfunctioning when exposed to liquids such as liquid vaporizable material, the presence of fluid in a gasket channel 310 or similar structure may act as a pressure column that results in different pressure readings detected by the absolute pressure sensor 604 depending on an orientation of the vaporizer device 100. Put another way, if a column of liquid is present in the channel 310, when the vaporizer device 100 is oriented such that gravity pulls this column toward the absolute pressure sensor 604, the absolute pressure sensor 604 may detect a larger absolute pressure than when the vaporizer device 100 is oriented such that gravity, centripetal force, etc. pulls this column away from the absolute pressure sensor 604. This effect can lead to an apparent pressure drop being indicated by the absolute pressure sensor 604 when the vaporizer device is rotated to cause a column of liquid in the channel 310 to be pulled by gravity away from the absolute pressure sensor 604, if a user swings the vaporizer device along an arc that causes momentum of such a liquid column to move away from the absolute pressure sensor 604, etc. An apparent pressure drop of this kind is likely not associated with a user taking a puff on the device. Various optional features of the current subject matter may be incorporated into a vaporizer device to assist the controller 105 or the logic-implementing features of the vaporizer device in discerning that a pressure drop caused by one of these factors or similar effects is not indicative of a user taking a puff. For example, signals from one or more additional sensors can be included in the logic discussed above. In some implementations of the current subject matter, an accelerometer or other motion sensing device may provide signals that are interpreted by the control logic. When a pressure drop relative to ambient pressure is indicated by signals from the absolute pressure sensor 604 and the additional absolute pressure sensor 606, the implemented puff detection logic can further include a determination of whether any other sensors of the vaporizer device have indicated that the detected pressure drop may be associated with additional factors that could incorrectly indicate an airflow-related pressure drop. If this determination indicates a different cause for the detected pressure drop, the controller or other implemented logic can reject the apparent puff.

When the controller 105 or other logic does determine that a puff is occurring, this determination can result in electric current from the power supply being delivered to a resistive heater that provides heating to vaporize some amount of the vaporizable material in a reservoir 120 to thereby result in generation of an inhalable aerosol in air flowing along the airflow path to the mouthpiece 144 and the outlets 156 therein.

It will be understood that the above description, which is related to a vaporizer device 100 that includes a cartridge 114 and a vaporizer device body 101, one of ordinary skill in the art will readily recognize that the use of an absolute pressure sensor 604 in a vaporizer device 200 that does not require the use of cartridges (e.g., because vaporizable material may be inserted into an over 220 for heating) may also be advantageous. As noted, such pressure sensors may be more sensitive and less prone to being damage or rendered inoperable by environmental factors. In such a vaporizer device, an absolute pressure sensor 604 can be positioned to be exposed to an airflow path connecting an air inlet, a vaporization chamber (e.g. an over, etc.) and an outlet, which can be in a mouthpiece 144. An additional absolute pressure sensor 606 can be positioned to be exposed to ambient pressure. Other sensors (e.g. a motion sensor, etc.) can optionally also provide signals used by control logic to determine whether a puff is occurring or whether the signal from the absolute pressure sensor 604 is being influenced by other factors.

Implementations of the current subject matter can also enable checking functionality of a pressure sensor at the board level. Because the absolute pressure sensor 604 provides a direct digital output signal of absolute pressure, devices can be tested for accurate functioning of such sensors immediately after assembly of the circuit board or other internal electronics rather than requiring full assembly of the device for testing. This capability can provide advantages in more efficient manufacturing in that error detection can be implemented at much earlier stages in a production process.

Additionally, because absolute pressure sensors as described herein for use with vaporizer devices can be functional even when exposed to water or other liquids, it can be possible to make the entire vaporizer device body 101 waterproof, for example by positioning the additional absolute pressure sensor 606 with access to air outside of the internal volume within the shell 303 and providing one or more gaskets or sealing features that seal the entirety of the internal volume (e.g. the power source 103, any circuitry, etc.) against ingress of liquids or other environmental factors.

In some implementations of the current subject matter, an accurate/absolute pressure sensor on a vaporization device can enable the device to provide other functions. For example, in a vaporizer device in which the airflow path 150 includes a known and well-characterized orifice size, an accurate measurement of the pressure drop resulting from a user taking a puff can be used to calculate an air velocity and volumetric flow rate. An accurate measurement of airflow volume can be used in conjunction with control of the temperature of the heater (or optional other factors influencing an amount of vaporizable material converted to the vapor phase per unit time) to control an amount of inhalable aerosol generated for a given volume of air. This capability can enable a vaporizer device to provide a consistent aerosol concentration across different puff strengths. Additionally, information from the additional absolute pressure sensor 606 can allow corrections for ambient pressure—for example to enable correction for effects of atmospheric pressure on an amount of airflow, etc.

Further improvements related to these capabilities can include enabling of a variable trip threshold for detecting a puff. In one example, the device may prompt a user to take a sample (e.g. a test) puff or a series of sample puffs such that the device can characterize and store information regarding how strong (or weak) the puffing power of a user is. With this information, the vaporizer device can vary the size of the pressure drop required to indicate a puff to thereby better detect actual puffs and reject false positives in detection of user puffing activity. Furthermore, this capability can also allow the device to avoid missing detection of puffs by enabling a lower puff detection threshold for weaker puffers.

Figure 7A:
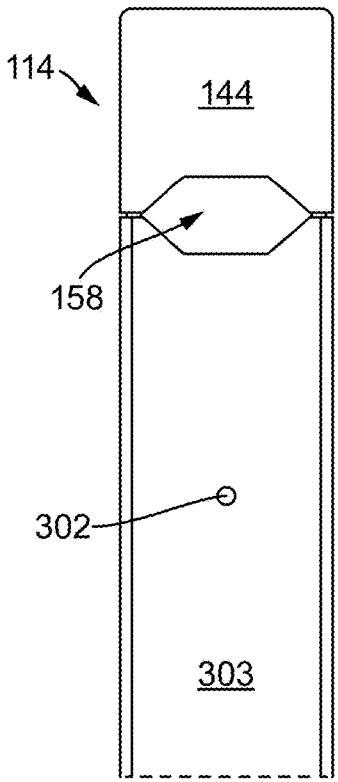
FIG. 7A shows a diagram illustrating a top view of a vaporizer device body consistent with implementations of the current subject matter.
Figure 7B:
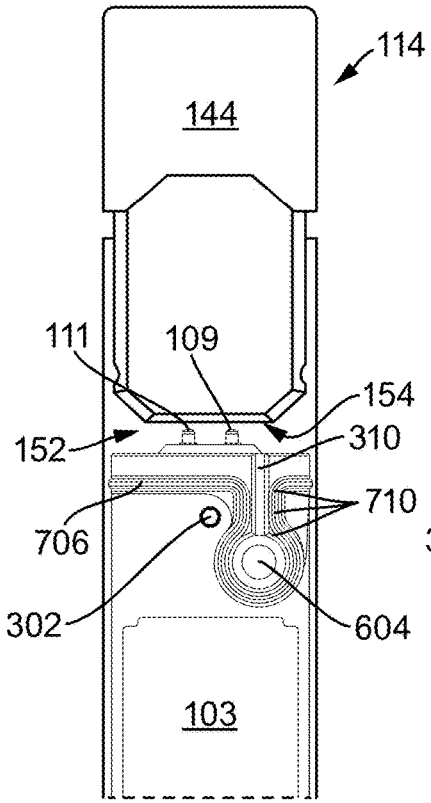
FIG. 7B shows a diagram illustrating a cutaway top view of a vaporizer device body having a gasket consistent with implementations of the current subject matter.
Figure 7C:
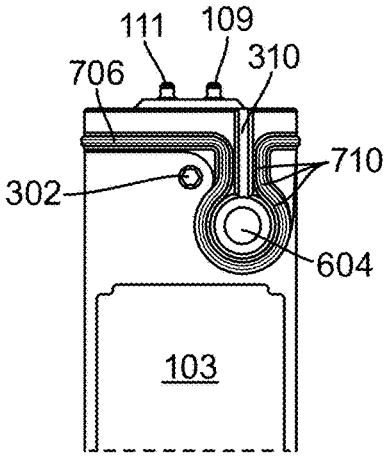
FIG. 7C shows a diagram illustrating another cutaway top view of a vaporizer device body having a gasket consistent with implementations of the current subject matter.
Figure 8:
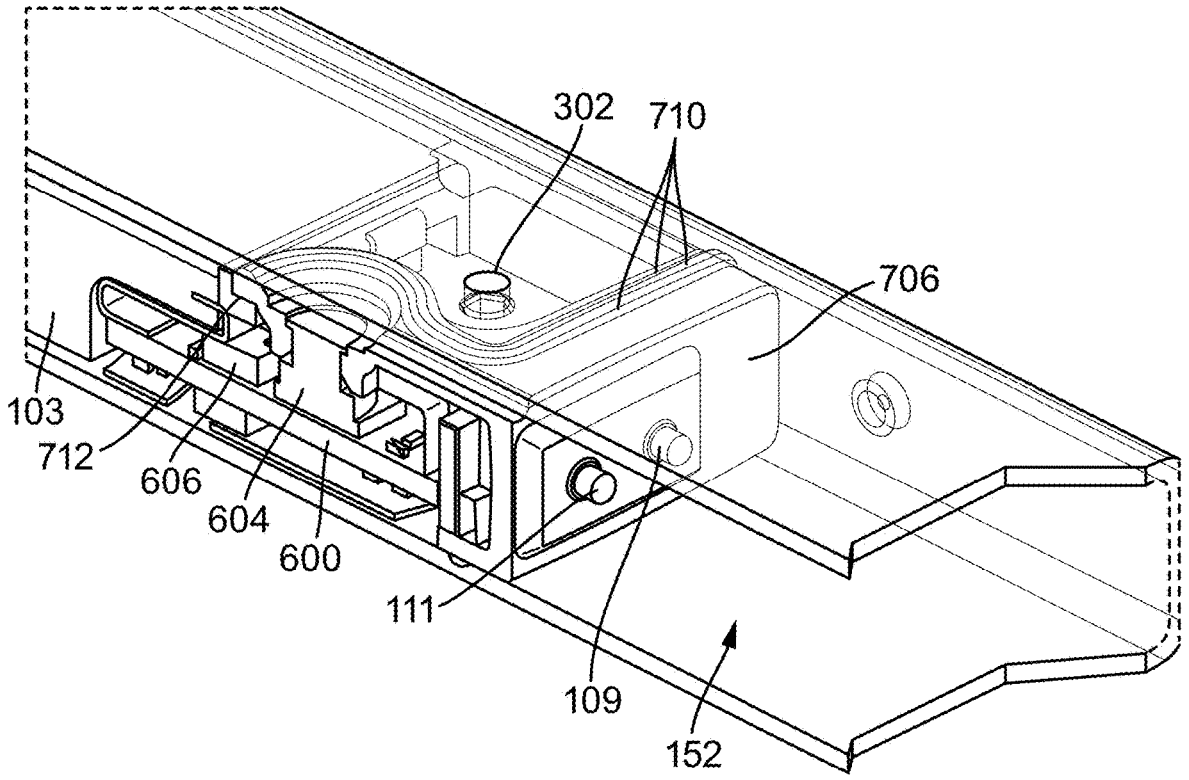
FIG. 8 shows a diagram providing a side/top isometric perspective view of a vaporizer device body illustrating features of a gasket consistent with implementations of the current subject matter.

With regard to the gasket 306 or other sealing feature in a vaporizer device 100, the current subject matter can also provide improvements over previously available approaches. Some potential modes of failure of such a gasket 306 may be due to deformation of the gasket 306 caused by mechanical, thermal, and/or chemical influences on the gasket material. Deformation of the gasket 306 by mechanical factors may result from bending of the vaporizer device shell 303, dropping of the vaporizer device, excessive pressure, optionally at an inopportune angle, used during insertion of a cartridge 114 into a cartridge receptacle 152, etc. To protect against such issues, a gasket 706 may include multiple redundant supporting ribs 710 as are shown in the views of FIG. 7B, FIG. 7C, and FIG. 8. FIG. 7A shows a similar view to that shown in FIG. 3A and is provided for reference with the view of FIG. 7B and FIG. 7C.

Alternatively or in addition, one or more supporting ribs 710 may be positioned at a distal side of the gasket 706, where the distal side of the gasket 706 is opposite from a side of the gasket closest to the cartridge receptacle 152. This positioning of the supporting rib(s) can provide additional bracing between a shell 303 of the vaporizer device body 101 and an internal skeleton 712.

The gasket 706 can be formed of a material that is resistant to swelling or other chemically induced changes that may occur due to contact with non-aqueous solvents, such as for example vegetable glycerin, propylene glycol, oils, etc. In some examples, the gasket 706 may be formed of silicon. In other examples, it may be formed of one or more of Silicone70A, NBR 70A, NANCAR 1052 70A, a mixture of 80% Silicone/20% Flourisilicone, 70A, or the like.

Further as noted above, the electrical contacts that complete the circuit between a power source in the vaporizer body and the heating element in the cartridge may have various modes of failure that arise due to contact with liquids (such as a liquid vaporizable material) while also conducting electricity. For example, an anti-corrosive plating or coating on these contacts may become eroded or even be completely broken through due to such galvanic effects. Furthermore, for electrical contacts that are spring-loaded, other elements of the contact such as the springs themselves, the plunger barrel, or the like can also experience corrosion related failure and/or excessive heating or other damage.

Figure 9:
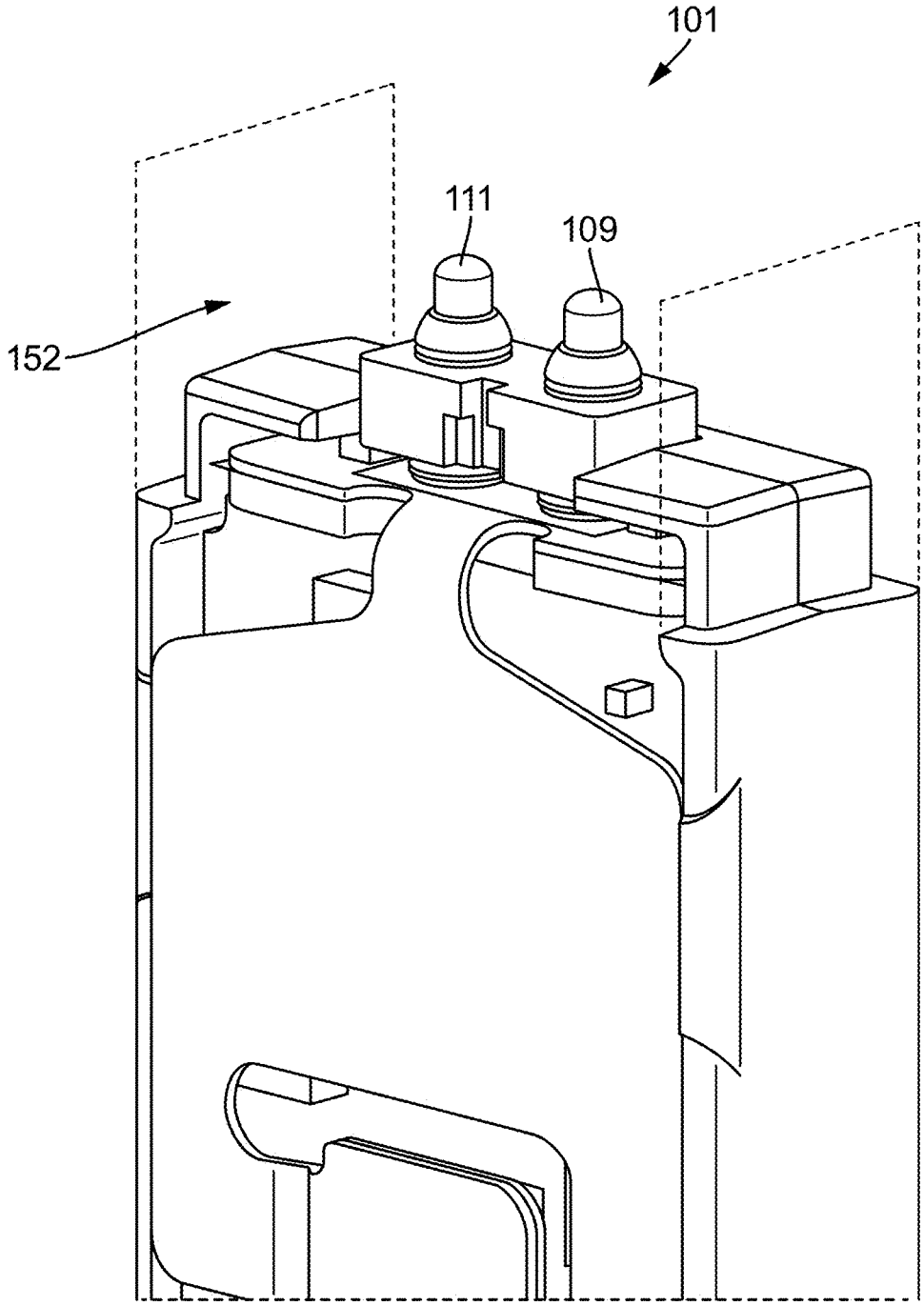
FIG. 9 shows an isometric perspective view of internal components of a vaporizer device body.

FIG. 9 shows an isometric view illustrating various features of the internal components of an example vaporizer device body 101. As shown, two vaporizer device body electrical contacts 109, 111 extend into a cartridge receptacle volume 152 configured to receive a cartridge having complementary cartridge contacts 119, 121 (not shown in FIG. 9). The vaporizer device body electrical contacts 109, 111 can, in some implementations of the current subject matter, be "pogo" style pins, optionally with internal springs that cause a plunger of each pin to be urged upward for contact with its corresponding complementary cartridge contacts 119 or 121. Implementations of the current subject matter can include one or more liquid-resistant features, such as for example those described below.

Figure 10:
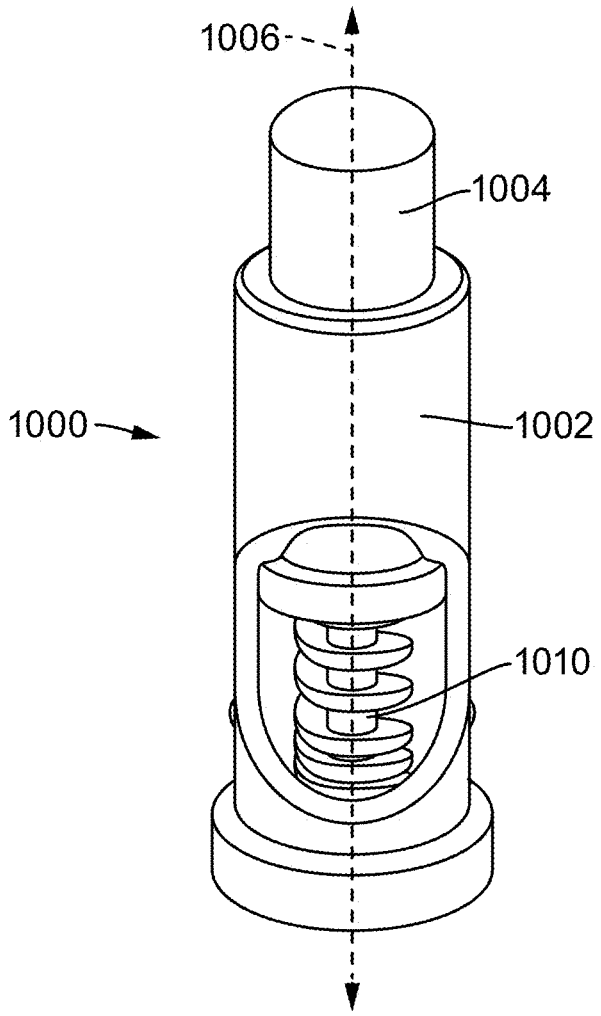
FIG. 10 shows an isometric perspective view of a pin structure that can be included as an electrical contact in a vaporizer device body consistent with implementations of the current subject matter.

FIG. 10 shows a diagram illustrating features of a spring pin 1000 consistent with implementations of the current subject matter. As illustrated, such a pin can include a barrel 1002, a plunger 1004 that is able to move along an axis 1006 of the barrel 1002, and a spring 1010 that urges the plunger 1004 outward along that axis 1006 to provide urging force capable of bringing the plunger into contact with another surface, such as a cartridge contact 119 or 121.

Damage to the plunger 1004 can occur due to corrosion, abrasion, foreign object contamination, or the like. As such, in certain implementations of the current subject matter, electrical contacts for use on the vaporizer device body 101 can be improved by inclusion of a liquid-resistant feature, which can optionally include one or more of an upgraded anti-corrosion coating, a broadened contact surface, and a structural feature (e.g. a modified construction). The structural feature may include elimination of a spring-driven feature and/or of features that require movement of two or more mechanical parts relative to one another.

In one example of a liquid-resistant feature, the spring 1010 may be formed of (or alternatively, coated with) a material that has a lower overall conductivity than the plunger 1004 and/or the barrel 1006. In this manner, the spring 1010 can be less susceptible to carrying electrical current, which can reduce the potential for corrosion and/or excessive heating of the spring.

In other implementations of the current subject matter, the vaporizer device body electrical contacts 109, 111 can be formed as solid contacts (e.g. without a spring or other urging feature. The complementary cartridge contacts 119, 121 can, consistent with this example, have flexibility or resilient features that enable a firm contact with the pins when the cartridge is coupled to the vaporizer device body 101.

Figure 11:
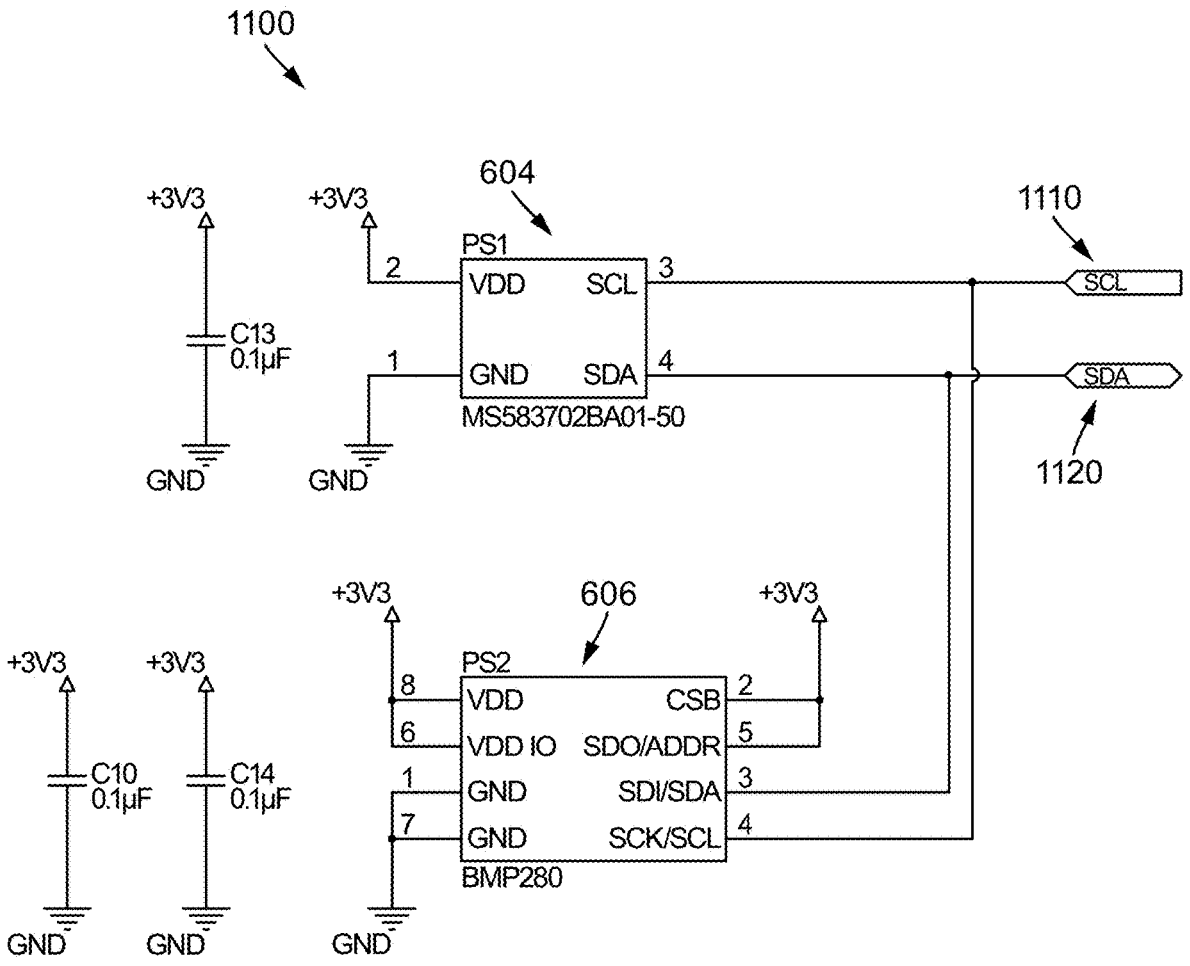
FIG. 11 shows a schematic diagram illustrating features of pressure sensors consistent with implementations of the current subject matter.

FIG. 11 shows an exemplary pressure sensor schematic diagram 1100 consistent with implementations of the current subject matter. As shown, PS1 604 is the "puff" sensor routed through the channel in the gasket to the pod of the device. PS2 606 is the ambient pressure sensor. In some implementations, PS1 604 may include a metal can housing to increase ease of mating to the gasket. PS1 604 may also include a "gel" inside the can to protect the actual sensor on the ceramic substrate below and to prevent the e-juice from damaging the sensor. The capacitors shown in FIG. 11 are power supply bypass capacitors for each pressure sensor PS1 604 and PS2 606. The pressure sensors PS1 604 and PS2 606 may communicate via I2C or other bus (SCL 1110/SDA 1120 as shown in FIG. 11) to the controller.

Figure 12:
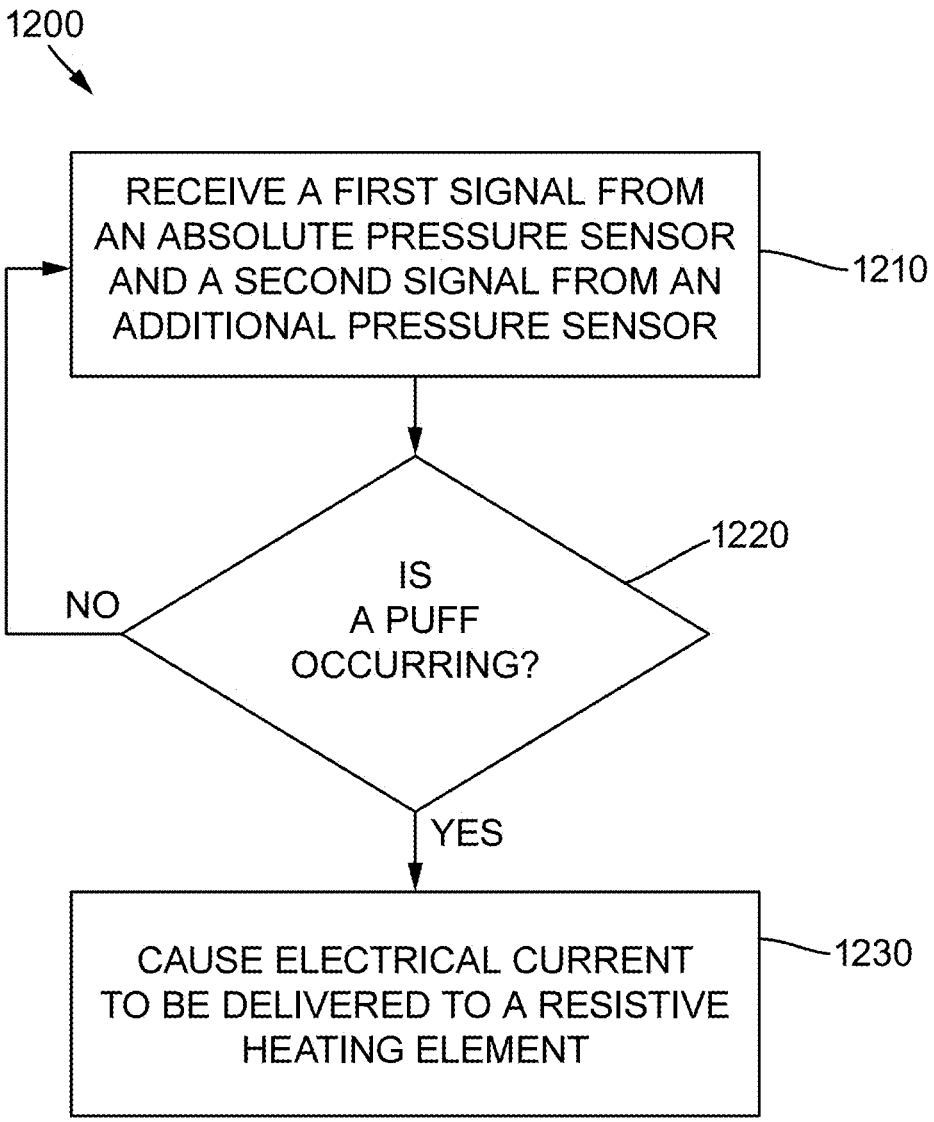
FIG. 12 shows a flow chart illustrating features of a method consistent with implementations of the current subject matter.

With reference to FIG. 12, a process flow chart 1200 illustrates features of a method, which can optionally include some or all of the following. At 1210, a first signal from an absolute pressure sensor (e.g., absolute pressure sensor 604) of a vaporizer device and a second signal from an additional pressure sensor (e.g., additional absolute pressure sensor 606) of the vaporizer device are received at electronic circuitry of the vaporizer device. The first signal represents a first pressure, and the second signal represents a second pressure. The absolute pressure sensor is disposed or positioned to experience the first pressure of air, which occurs along an airflow path connecting air outside of a vaporizer device body with a vaporization chamber of the vaporizer device and a mouthpiece of the vaporizer device. The additional absolute pressure sensor is disposed or positioned to detect the second pressure of air, which is representative of ambient air pressure to which the vaporizer device is exposed.

At 1220, the electronic circuitry determines that a puff is occurring based on at least the first signal and the second signal. Consistent with implementations of the current subject matter, air flowing along the airflow path in reaction to a user drawing on the mouthpiece is indicative of a puff occurring.

At 1230, in response to such a determination of a puff occurring, the electronic circuitry causes electrical current to be delivered to a resistive heating element of the vaporizer device.

As noted above, the subject matter of this disclosure may be relevant to both electronic cigarettes in particular and vaporizer devices in general, including vaporizer devices for use with any of a variety of vaporizable materials. As such, the discussion herein of various features is generally framed in terms of vaporizer devices. One of ordinary skill in the art will readily understand based on the descriptions and explanations herein how to apply such features to particular use cases, including but not limited to electronic cigarettes and other vaporizer devices. Incorporation of one of more features of the current subject matter in a vaporizer device may provide improvements with regard to various usability, durability, and dependability issues that may affect currently available vaporizer devices.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device.

These computer programs, which can also be referred to as programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital image capture devices and associated interpretation software, and the like. A computer remote from an analyzer can be linked to the analyzer over a wired or wireless network to enable data exchange between the analyzer and the remote computer (e.g. receiving data at the remote computer from the analyzer and transmitting information such as calibration data, operating parameters, software upgrades or updates, and the like) as well as remote control, diagnostics, etc. of the analyzer.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A vaporizer device comprising:

an absolute pressure sensor positioned to detect a first pressure of air along an airflow path connecting air outside of a vaporizer device body with a vaporization chamber of the vaporizer device and a mouthpiece of the vaporizer device;

an additional absolute pressure sensor positioned to detect a second pressure of air representative of ambient air pressure to which the vaporizer device is exposed; and a controller configured to perform operations comprising:

receiving a first signal from the absolute pressure sensor representative of the first pressure and a second signal from the additional absolute pressure sensor representative of the second pressure, determining, based on at least the first signal and the second signal, that a puff is occurring, the puff comprising air flowing along the airflow path in reaction to a user drawing on the mouthpiece, and causing, in response to the determining, an electrical current to be delivered to a resistive heating element of the vaporizer device, the electrical current causing heating of a vaporizable material for forming of an inhalable aerosol in the air flowing along the airflow path.

2. A vaporizer device as in claim 1, further comprising an additional sensor, and wherein the operations further comprise receiving a third signal from the additional sensor and adapting the determining that the puff is occurring based on the third signal.

3. A vaporizer device as in claim 2, wherein the additional sensor comprises an accelerometer or another motion sensing device.

4. A vaporizer device as in claim 1, wherein the airflow path includes a known and well-characterized orifice size, and wherein the absolute pressure sensor provides a measurement of a pressure drop resulting from a user taking the puff, wherein the operations performed by the controller further comprise:

calculating an air velocity and volumetric flow rate;

determining an amount of the vaporizable material converted to a vapor phase per unit time; and controlling an amount of the inhalable aerosol generated for a given volume of air based on the calculating and the determining.

5. A vaporizer device as in claim 4, wherein the operations performed by the controller further comprise: controlling a temperature of the resistive heating element.

6. A vaporizer device as in claim 4, wherein the operations performed by the controller further comprise: providing a consistent aerosol concentration across different puff strengths.

7. A vaporizer device as in claim 4, wherein the operations performed by the controller further comprise: applying a correction for ambient pressure to correct for effects of atmospheric pressure on an amount of airflow.

8. A vaporizer device as in claim 4, wherein the operations performed by the controller further comprise:

prompting the user to take a sample puff or a series of sample puffs; and characterizing and storing information regarding a relative strength of a puffing power of the user.

9. A vaporizer device as in claim 8, wherein the operations performed by the controller further comprise: varying a size of the pressure drop required to indicate a puff based on the relative strength of the puffing power of the user to better detect actual puffs and reject false positives in detection of user puffing activity.

10. A method comprising:

receiving, at electronic circuitry, a first signal from an absolute pressure sensor of a vaporizer device and a second signal from an additional absolute pressure sensor of the vaporizer device, the first signal representing a first pressure of air, and the second signal representing a second pressure of air, the absolute pressure sensor disposed to experience the first pressure of air, which occurs along an airflow path connecting air outside of a vaporizer device body of the vaporizer device with a vaporization chamber of the vaporizer device and a mouthpiece of the vaporizer device, the additional absolute pressure sensor disposed to detect the second pressure of air, which is representative of ambient air pressure to which the vaporizer device is exposed;

determining that a puff is occurring based on at least the first signal and the second signal, the puff comprising air flowing along the airflow path in reaction to a user drawing on the mouthpiece; and causing electrical current to be delivered to a resistive heating element of the vaporizer device in response to the determining.

11. A method as in claim 10, wherein the vaporizer device further comprises an additional sensor, and wherein the method further comprises receiving a third signal from the additional sensor and adapting the determining that the puff is occurring based on the third signal.

12. A method as in claim 11, wherein the additional sensor comprises an accelerometer or another motion sensing device.

13. A method as in claim 10, wherein the airflow path includes a known and well-characterized orifice size, and wherein the absolute pressure sensor provides a measurement of a pressure drop resulting from a user taking the puff, wherein the method further comprises:

calculating an air velocity and volumetric flow rate;

determining an amount of a vaporizable material converted to a vapor phase per unit time; and controlling an amount of an inhalable aerosol generated for a given volume of air based on the calculating and the determining.

14. A method as in claim 13, further comprising: controlling a temperature of the resistive heating element.

15. A method as in claim 13, further comprising: providing a consistent aerosol concentration across different puff strengths.

16. A method as in claim 13, further comprising: applying a correction for ambient pressure to correct for effects of atmospheric pressure on an amount of airflow.

17. A method as in claim 13, further comprising:

prompting the user to take a sample puff or a series of sample puffs; and characterizing and storing information regarding a relative strength of a puffing power of the user.

18. A method as in claim 17, further comprising: varying a size of the pressure drop required to indicate a puff based on the relative strength of the puffing power of the user to better detect actual puffs and reject false positives in detection of user puffing activity.

* * * * *